US006909866B2

(12) United States Patent
Kawai

(10) Patent No.: US 6,909,866 B2
(45) Date of Patent: Jun. 21, 2005

(54) DRIVE SYSTEM FOR AN IMAGE FORMING APPARTUS WHICH TRANSMITS A DRIVE FORCE TO A PHOTOSENSITIVE DRUM OF A PROCESS CARTRIDGE

(75) Inventor: Hideaki Kawai, Uji (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/439,513

(22) Filed: May 16, 2003

(65) Prior Publication Data

US 2003/0215265 A1 Nov. 20, 2003

(30) Foreign Application Priority Data

May 17, 2002 (JP) ..... 2002-143547

(51) Int. Cl.[7] ..... G03G 15/00
(52) U.S. Cl. ..... 399/167
(58) Field of Search ..... 399/167, 116, 399/117, 111

(56) References Cited

U.S. PATENT DOCUMENTS 6,175,706 B1 * 1/2001 Watanabe et al. ..... 399/167

FOREIGN PATENT DOCUMENTS

| | | |
|---|---|---|
| JP | 10-074031 | 3/1998 |
| JP | 10-090967 | 4/1998 |
| JP | 10-153938 | 6/1998 |

* cited by examiner

*Primary Examiner*—Quana Grainger
(74) *Attorney, Agent, or Firm*—Hogan & Hartson, LLP

(57) ABSTRACT

An image forming apparatus includes a drive source which is detachably mountable to a main body, wherein the main body includes a gear which can be driven rotatable by the drive source and which includes a coupling protrusion on a radial line. A process cartridge includes a photosensitive drum, a process unit which acts upon the photosensitive drum, and a coupling hole which is provided at an end part of a radial direction of the photosensitive drum. The photosensitive drum set in the main body rotates by receiving a drive force from the drive source via the coupling protrusion and the coupling hole when a cover member of the main body is closed, and the coupling protrusion and the coupling hole are fit together.

11 Claims, 25 Drawing Sheets

DRIVE SYSTEM FOR AN IMAGE FORMING APPARTUS WHICH TRANSMITS A DRIVE FORCE TO A PHOTOSENSITIVE DRUM OF A PROCESS CARTRIDGE

CROSS REFERENCES TO RELATED APPLICATIONS

This application claims priority under 35 USC 119 to Japanese Patent Application No. 2002-143547 filed in the Japanese Patent Office (JPO) on May 17, 2002, the entire disclosure of which is incorporated herein by reference.

BACKGROUND OF THE INVENTION

1. Field of the Invention

The present invention relates to a drive system which transmits a drive force to a photosensitive drum of a process cartridge detachably mountable to an image forming apparatus. The present invention also relates to an image forming apparatus which includes the process cartridge.

2. Description of the Related Art

In image forming apparatuses such as a printer, a facsimile machine, and a copying machine, a photosensitive drum is charged uniformly by a charging unit. An exposing unit selectively exposes the photosensitive drum according to image information scanned by an image reading unit or received facsimile data. Then, electrostatic latent image is formed on the photosensitive drum. A developing unit forms a toner image on the electrostatic latent image. A transfer unit transfers the toner image onto a paper fed from a paper feeding unit, and the image is recorded on the paper.

A conventional process cartridge integrally includes a photosensitive drum, a charging unit, a developing unit, and a cleaning unit. The process cartridge is detachably mountable to the image forming apparatus. The process cartridge includes the photosensitive drum, and at least one of the charging unit, the developing unit, or the cleaning unit.

An electro-photographic typed image forming apparatus, which uses an electro-photographic image forming process, includes a photosensitive drum, and a process unit which is actable to the photosensitive drum. In the electro-photographic typed image forming apparatus, a process cartridge is used as a unit which is detachably mountable to the image forming apparatus. By using the process cartridge, it is not necessary for a user to depend on a service worker, and the user can carry out the maintenance of the machine. As a result, operationality is improved. For example, even when the amount of toner remaining in the process cartridge becomes low, or when there is a failure in the photosensitive drum, if the process cartridge is replaced with a new cartridge, the image forming apparatus can be recovered to a normal state.

A drive system for the photosensitive drum in the process cartridge type is desirable to have a structure in which the process cartridge can be easily detachably mounted to the image forming apparatus, and a drive force is transmitted accurately to the photosensitive drum.

SUMMARY OF THE INVENTION

According to a first aspect of the present invention, a process cartridge can be detachably mounted to an image forming apparatus which includes a drive source and a gear. The gear is rotated by the drive source, and includes a coupling protrusion on a radial line. The process cartridge includes a photosensitive drum, a process unit which acts upon the photosensitive drum, and a coupling hole which is provided at an end part of a radial direction of the photosensitive drum. When a cover member (which forms an outer wall) of the image forming apparatus is closed, the coupling protrusion and the coupling hole are fit together. Then, the photosensitive drum, which is provided inside the image forming apparatus, is rotated by the drive source via the coupling protrusion and the coupling hole. Accordingly, the photosensitive drum is prevented from rotating eccentrically, and the quality of recorded image can be maintained. In addition, an unnatural force is not applied to a joined part between a drive force supplying shaft of a drive output gear and drive force receiving shaft of the photosensitive drum.

According to a second aspect of the present invention, the drive system includes a member which slides the gear of the image forming apparatus when the cover member is opened or closed. When the cover member is opened, the drive force supplying shaft and the drive force receiving shaft are released from the fit state, and the process cartridge can be removed from the image forming apparatus. When the cover member is closed, the coupling hole of the photosensitive drum and the coupling protrusion of the gear are fit together, and the photosensitive drum can be rotated by the drive source.

According to a third aspect of the present invention, a joining face is formed on the coupling protrusion of the gear. In addition, a joining face is formed on the coupling hole which is provided at the end part of the radial direction of the photosensitive drum. The joining surfaces are fit together, and the drive force from the drive source can be transmitted. The gear is a helical gear. To release the coupling protrusion of the gear and the coupling hole of the photosensitive drum from the fit state, the helical gear is slid in a direction to separate from the drive force receiving shaft. Then, the helical gear rotates in a direction opposite to the direction to transmit the drive force according to a mesh with the gear which transmits the drive force from the drive source to the helical gear.

DETAILED DESCRIPTION OF THE PREFERRED EMBODIMENTS

An image forming apparatus according to an embodiment of the present invention will be described specifically with reference to the drawings.

(Overall Configuration)

Figure 1:
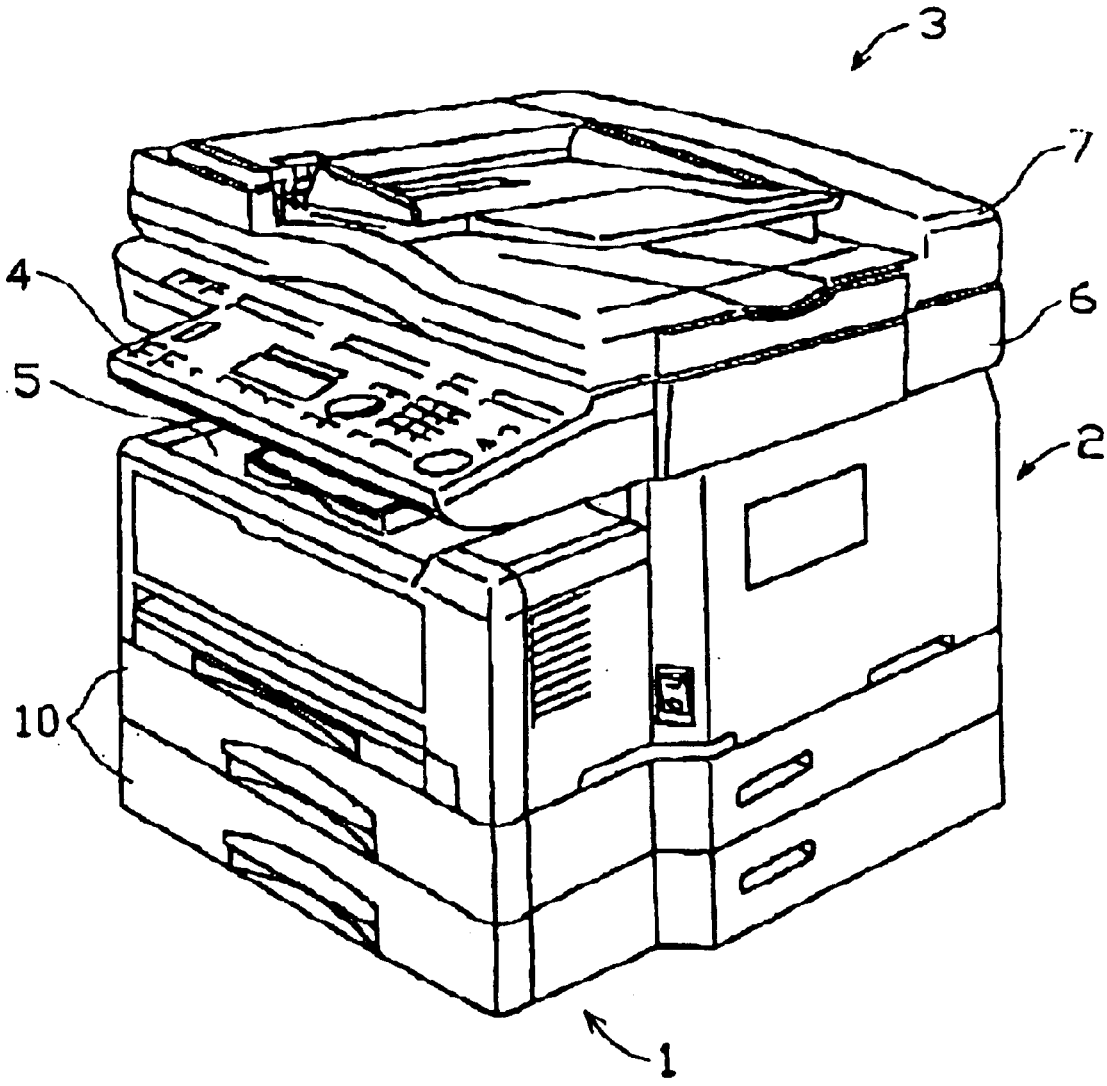
FIG. 1 is a schematic perspective view showing an outer configuration of an image recording unit 2 according to an embodiment of the present invention.

FIG. 1 is a perspective view showing an outer appearance of a copy and facsimile composite machine which includes the image forming apparatus of the present embodiment. As shown in the drawing, in the copy and facsimile composite machine, an image recording unit 2 is provided above a paper feeding unit 1. In addition, a scanner unit 3 is provided above the image recording unit 2. A recorded paper discharge tray is provided in a space formed between the image recording unit 2 and the scanner unit 3.

The paper feeding unit 1 includes a plurality of paper feeding cassettes 10, and a paper conveyance path. Each of the paper feeding cassettes 10 accommodates paper of a size different from the size accommodated in other paper feeding cassettes 10. In accordance with an input from an operation part 4 of the scanner unit 3, a paper of a requested size is fed from either one of the paper feeding cassettes 10, and the paper is fed to the image recording unit 2.

The scanner unit 3 can scan image of an original in the following ways. In case of a book or the like set on a reading frame 6, a scanner (not shown in the drawing) such as a Charge-Coupled Device (CCD) that is provided inside the reading frame 6, scans the book or the like. In case of sheet documents to be fed by an automatic document feeder (ADF) that is provided on a document cover 7, the scanner is brought to a prescribed position, and reads the image of the fed sheet document continuously.

As it is widely known, a paper conveyance path is formed inside the image recording unit 2 for conveying the paper fed from the paper feeding unit 1. A conveyance roller, a photosensitive drum, a transfer unit, and a fuser or the like are provided along the paper conveyance path. The conveyance roller feeds the paper. The photosensitive drum and the transfer unit record an image on the paper. The fuser fixes on the paper, the toner image transferred onto the paper as a permanent image.

In the image recording unit 2, after the photosensitive drum is charged uniformly by a charging device, an exposure is carried out selectively by an exposing device according to image information read by the scanner unit 3, or the facsimile received information. Then, electrostatic latent image is formed on the photosensitive drum. A developing device supplies toner to the electrostatic latent image, and the toner image is formed. A transfer device transfers the toner image onto the paper fed from the paper feeding unit 1. The paper is further conveyed, and a fusing device fuses the toner by heat to fix the toner image onto the paper. Then, the paper is conveyed to the paper discharge tray 5. When there are plural pages of originals or facsimile received information, the above process is repeated, and the paper recorded with the image is discharged to the paper discharge tray 5 one after the other.

The photosensitive drum, and a process device such as the charging device or the exposing device which acts upon the photosensitive drum, the developing device, and a toner container, are formed integrally to the process cartridge. The process cartridge is detachably mountable to the image recording unit 2. This configuration is adopted for a convenience of when carrying out maintenance to the image recording unit 2.

Figure 2:
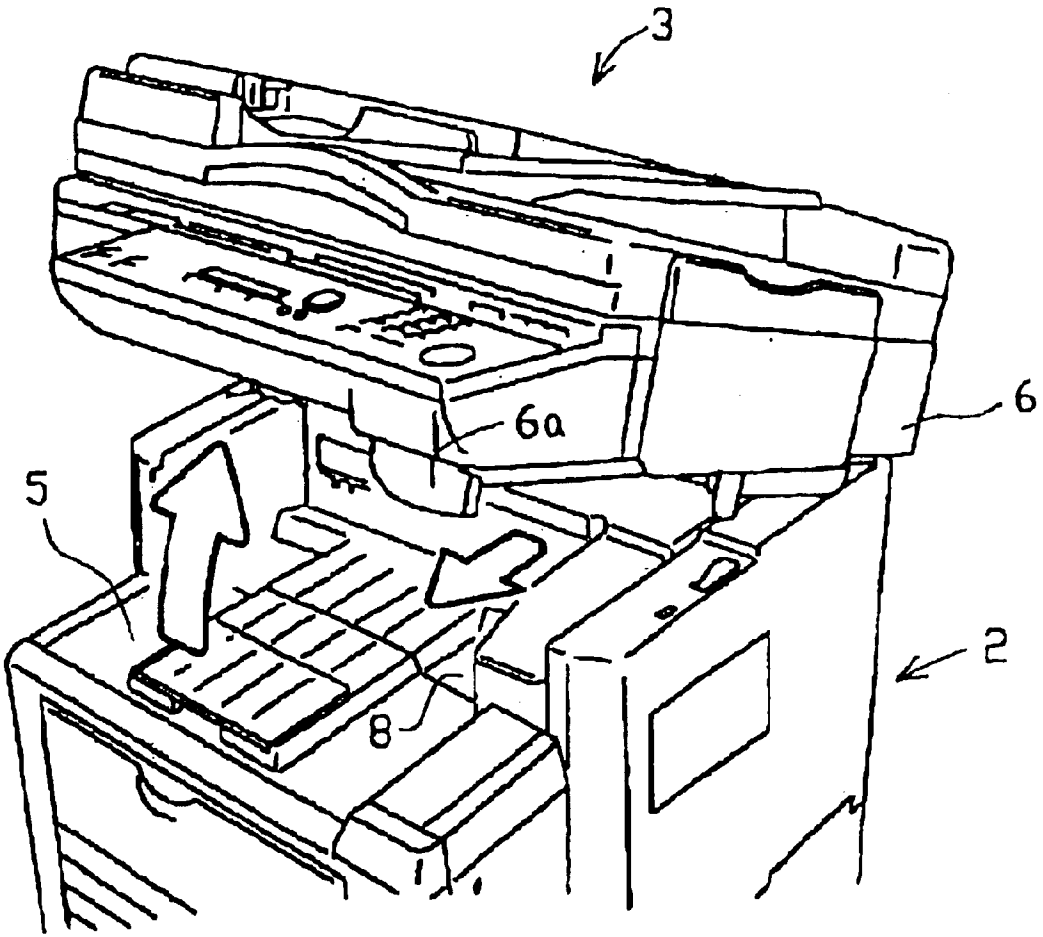
FIG. 2 is a perspective view showing a state in which a front side of a scanner unit 3 is swung upward.
Figure 3:
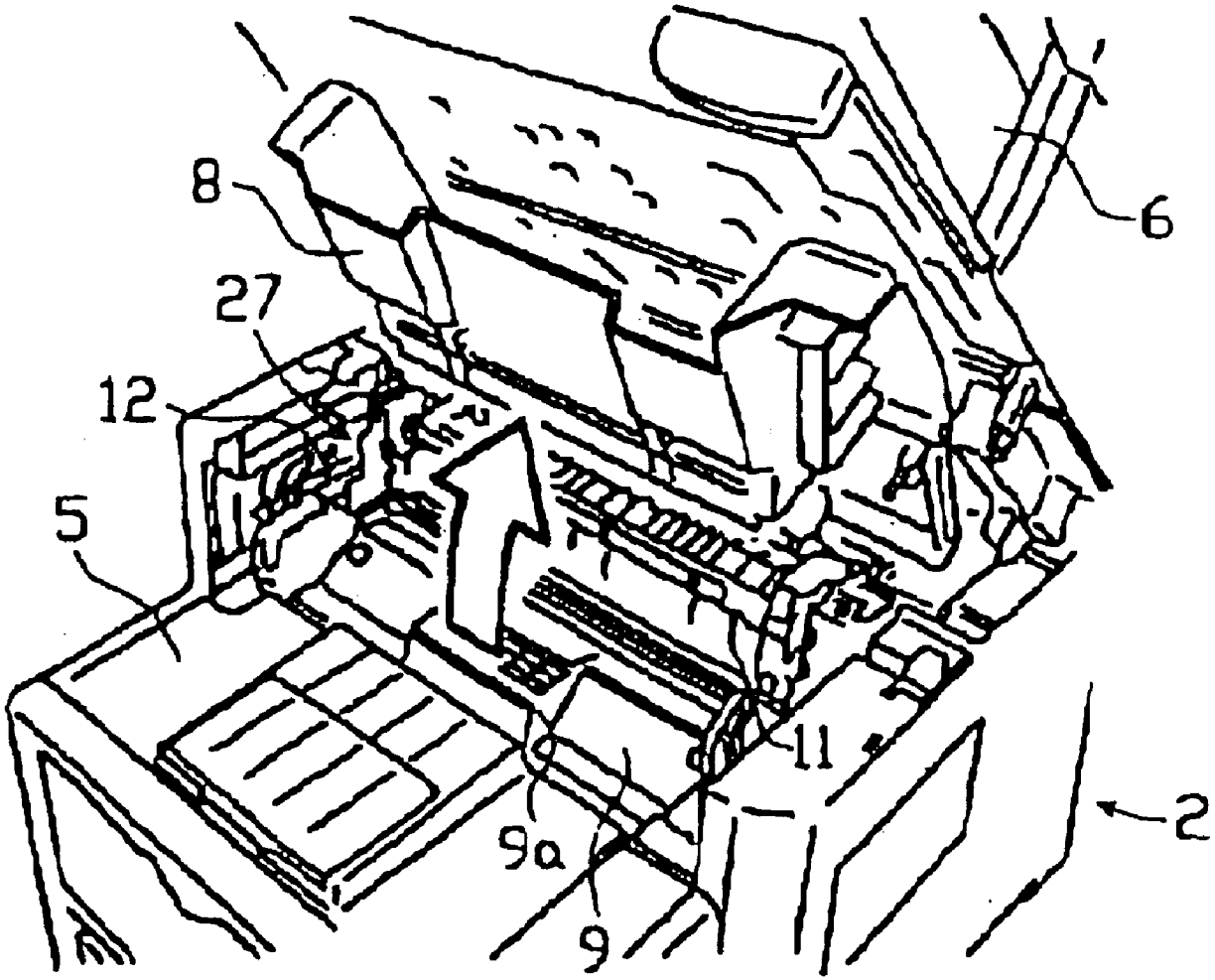
FIG. 3 is a perspective view showing a state in which a top cover 8 is opened.
Figure 4:
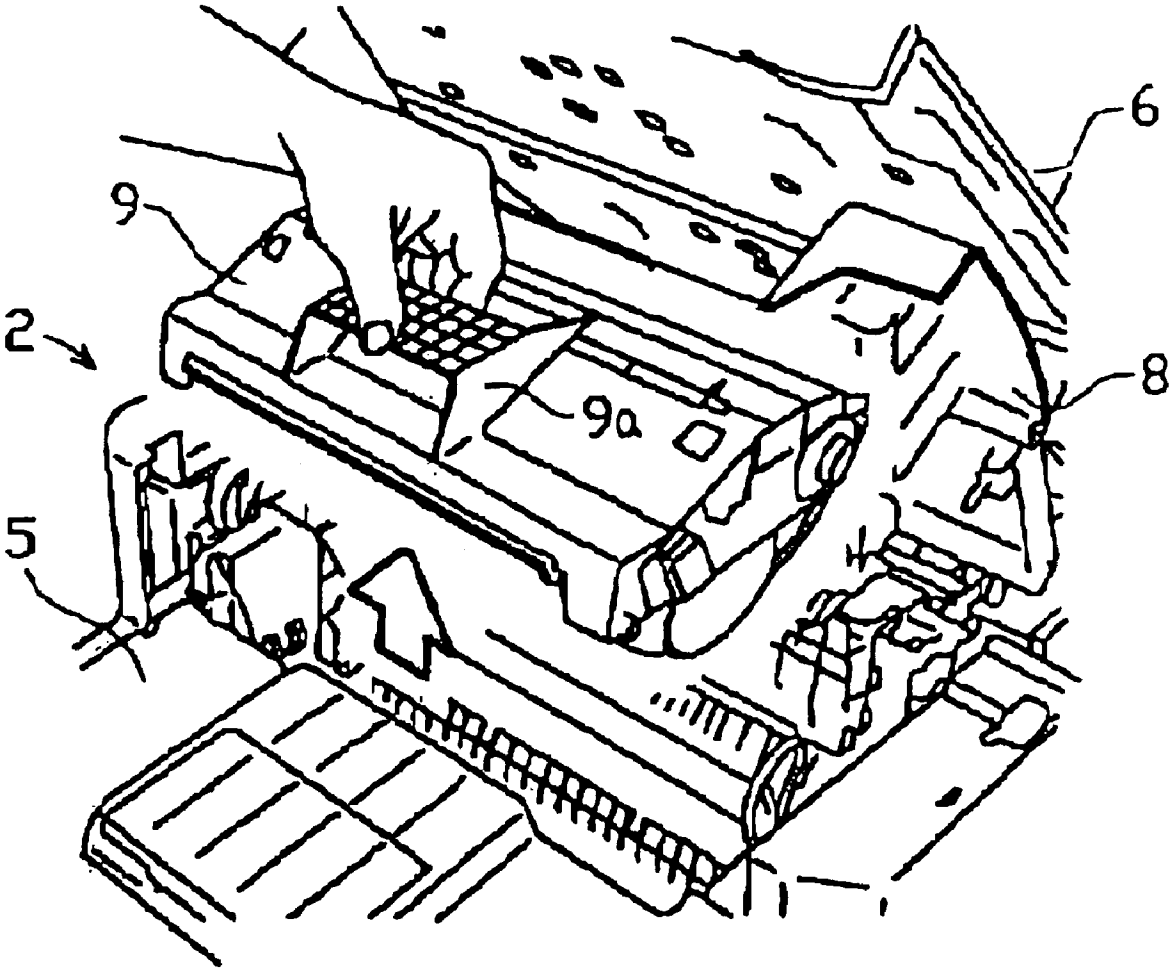
FIG. 4 is a perspective view showing a state in which a process cartridge 9 is pulled out.
Figure 5:
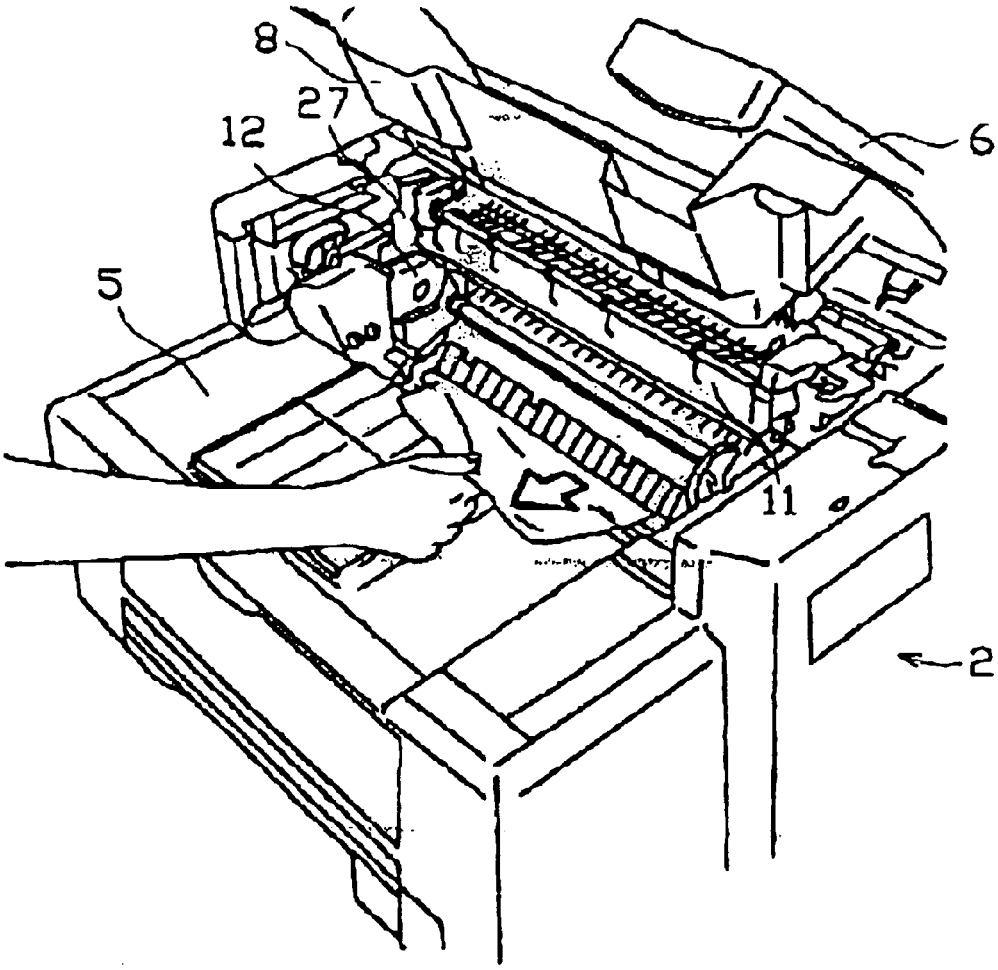
FIG. 5 is a perspective view showing a work to eliminate a paper jam.

FIG. 2 through FIG. 5 show a procedure to eliminate a paper jam in the paper conveyance path of the image recording unit 2. As shown in FIG. 2, a lever 6*a* is provided on a front-lower side of the reading frame 6. When the user pulls the lever 6*a*, a locked state of the scanner unit 3 with respect to the image recording unit 2 is released, and the scanner unit 3 can be swung upward with a fulcrum as a center. By swinging a front side of the scanner unit 3 upward with a rear side of the image forming apparatus as the fulcrum, an upper part of the image recording unit 2 can be opened. Then, the top cover 8 of the image recording unit 2 is exposed. The top cover 8 is a part of the discharge tray 5 where the recorded paper is discharged. The top cover 8 can be opened and closed from the front side with an inner side (rear side of the image forming apparatus) supported pivotally. When the top cover 8 is opened, an opening for the process cartridge is opened. Then, as shown in FIG. 3, the process cartridge 9, the fuser 11 or the like which are provided inside the image recording unit 2 are exposed to the outside. The process cartridge 9 is detachably mountable in a vertical direction. As shown in FIG. 4, the process cartridge 9 can be removed from the image recording unit 2 by picking up a gripper 9*a*. The gripper 9*a* is formed on the upper surface of the process cartridge 9. By removing the process cartridge 9, the paper conveyance path is exposed. Then, as shown in FIG. 5, the paper which had caused a paper jam in the conveyance path can be removed completely. As described above, the process cartridge 9 can be easily attached and detached by the user without using tools such as a driver.

(Configuration of Drive Input Shaft of Process Cartridge)

Figure 6A:
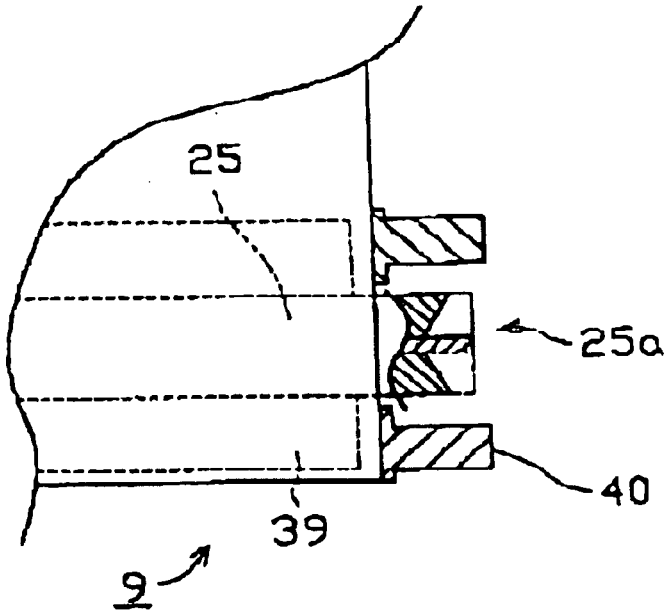
FIG. 6A is an enlarged partial cross-sectional view of an end part of a drive force receiving shaft of the process cartridge 9.
Figure 6B:
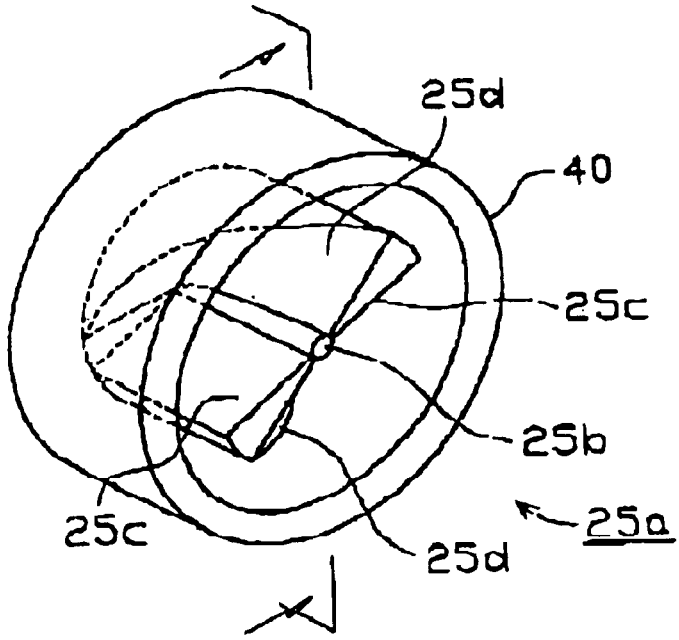
FIG. 6B is an enlarged perspective view showing a detailed configuration of a coupling part 25*a*.

As shown in FIG. 6A, a photosensitive drum 39 is stored in the process cartridge 9. The photosensitive drum 39 can rotate with a drive force receiving shaft as an axis. One end of the drive force receiving shaft is protruding from a side of the process cartridge 9. A coupling part 25*a* is formed on an end section of the drive force receiving shaft of the protruding side. A circular guide 40 is provided integrally or separately on a side surface of the process cartridge 9 to surround a side peripheral surface of the protrusion of the drive force receiving shaft. As shown in FIG. 6B, the coupling part 25*a* includes a column-shaped core part 25*b*, drive force receiving surfaces 25*c*, and slanting surfaces 25*d*. The core part 25*b* is formed at a shaft center of the helical gear 240. Two drive force receiving surfaces 25*c* are formed in a radial direction from the core part 25*b* such that to be symmetrical with the core part 25*b* as the center. Each of the slanting surfaces 25*d* is formed to be slanting from a tip end of one of the drive force receiving surfaces 25*c* toward a base end of the other drive force receiving surface 25*c* in a counterclockwise direction. The rotational drive force in the counterclockwise direction input to the coupling part 25*a* is transferred to the drive force receiving shaft via the core part 25*b*, and the photosensitive drum 39 is rotated.

(Drive Unit)

As shown in FIG. 5, a drive unit 12 is fixed on a side of a position where the processing cartridge 9 is set. The drive unit 12 transfers the drive force from the image forming apparatus to the process cartridge 9 and the fuser 11. Next, the drive unit 12 will be described in details.

Figure 7:
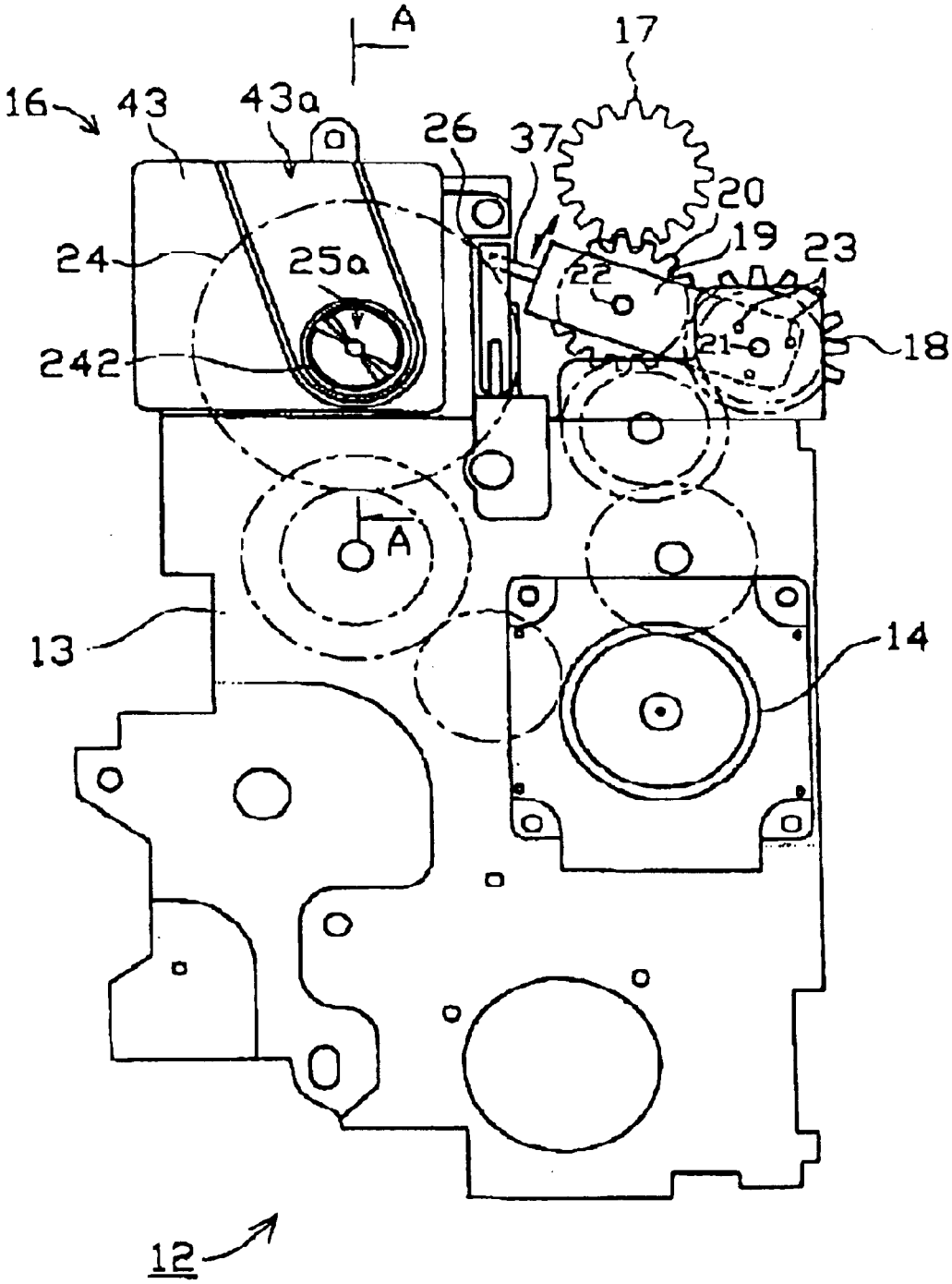
FIG. 7 is a side view of a drive unit 12.

FIG. 7 is a side view showing the entire drive unit 12. As shown in the drawing, the drive unit 12 includes a frame body 13 as a frame formed from sheet metal. A motor 14 which is a drive source is fixed in a cantilever on one side of the frame body 13. Moreover, a train of gears (shown with dashed lines in the drawing) which transfer power of the motor 14 are supported inside the frame body 13. Furthermore, two drive output parts, a fuser drive output part 15 and a cartridge drive output part 16, are provided on the frame body 13. The drive force of the motor 14 is transmitted constantly to the two drive output parts 15, 16 via the train of gears.

(Fuser Drive Output Part)

Figure 8:
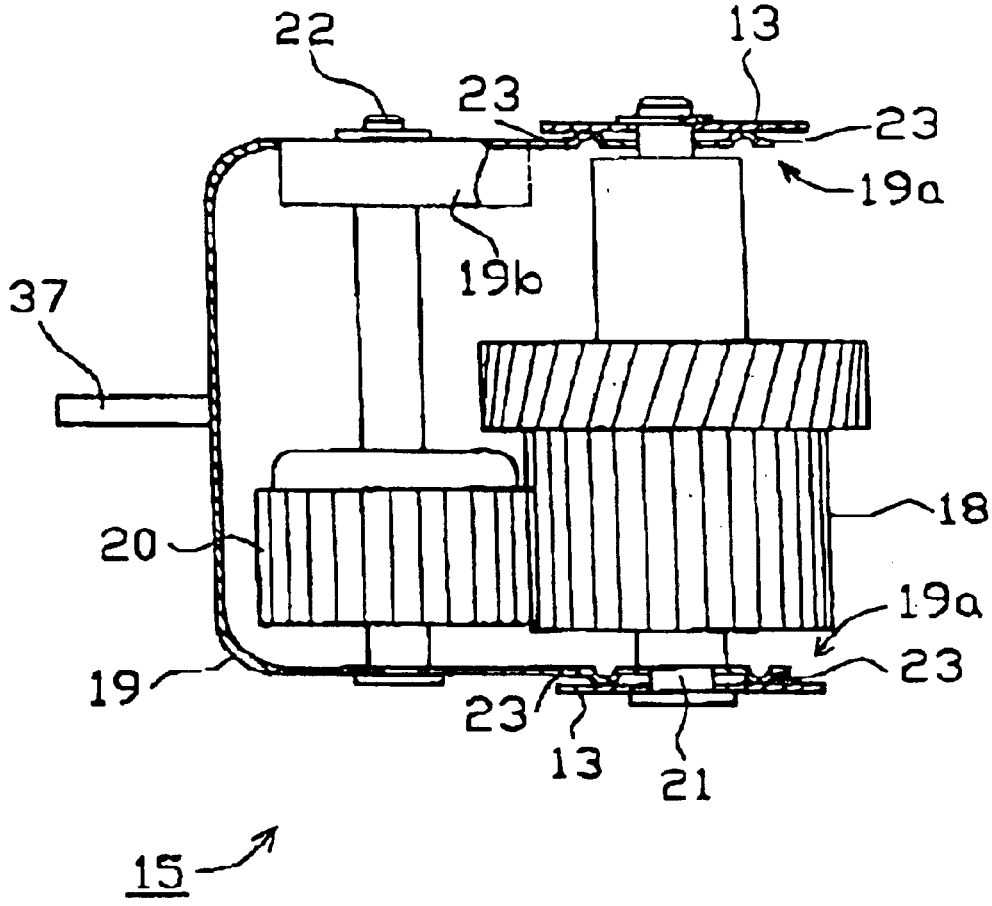
FIG. 8 is a plan view of a fuser drive output part 15.

As shown in FIG. 7, the fuser drive output part 15 transmits the drive force transmitted from the motor 14 via the train of gears to a fuser drive input gear 17. The fuser drive output part 15 can mesh with or separate from the fuser drive input gear 17. In addition, the fuser drive output part 15 transmits or cuts off the drive force. FIG. 8 is a cross-sectional plan view showing a configuration of the fuser drive output part 15 of the drive unit 12. As shown in the drawing, the fuser drive output part 15 is supported by the frame body 13. The fuser drive output part 15 includes a sun gear 18, a swing arm 19, and a planet gear 20. The sun gear 18 is connected to the motor 14 via the train of gears. The swing arm 19 is pivotally supported by the frame body 13 such that the swing arm 19 can swing with a shaft center the same as the shaft center of the planet gear 18 as the center. The planet gear 20 is supported by the swing arm 19, and is meshed with the sun gear 18 at all times.

The sun gear 18 can be rotated by a sun gear shaft 21 which is built over the frame body 13. The swing arm 19 is formed by bending sheet metal into a shape of a horseshoe in a plan view. Both end parts of the swing arm 19 will be referred to as swing base parts 19*a*. The swing base parts 19*a* are pivotally supported by the sun gear shaft 21. Three small protrusions 23 are formed on an outer surface of each of the swing base parts 19*a* respectively. Each of the protrusions 23 has a domelike roundness. A summit of the protrusion 23 contacts against an inner surface of the frame body 13. Accordingly, a contacting area of the frame body 13 and the swing arm 19 is narrowed, and a friction of when the swing arm 19 swings is reduced. In addition, the swing arm 19 can be swung smoothly, and noise is prevented from generating. Moreover, work for secondary processing such as deburring can be eliminated, and the manufacturing cost can be reduced.

A planet gear shaft 22 is provided in parallel to the sun gear shaft 21 inside the swing arm 19. The planet gear 20 is provided around the planet gear shaft 22, and the planet gear 20 can rotate by being meshed with the sun gear 18. The swing arm 19 swings with the sun gear shaft 21 as the axis. Therefore, a distance between the sun gear shaft 21 and the planet gear shaft 22 is constant also when the swing arm 19 swings. The sun gear 18 and the planet gear 20 are maintained under the meshed state also when the swing arm 19 swings.

Further, in the present embodiment, the protrusions 23 are provided on the outer surface of the swing arm 19. However, the present invention is not limited to this example, and the same effect can be obtained even when the protrusions 23 are provided on an inner surface of the frame body 13. Therefore, the protrusions 23 can be provided to either the frame body 13 or the swing arm 19 at a part of a surface where the frame body 13 and the swing arm 19 are facing with one another.

In addition, the shape of the protrusions 23 is not limited to the shape disclosed in the present embodiment. The shape of the protrusions 23 can be in other shapes which can reduce the area where the frame body 13 and the swing arm 19 contact against one another. The protrusions 23 are preferable to be formed convexly. Moreover, as shown in the present embodiment, it is especially preferable to form the protrusions 23 in a domelike shape such that the frame body 13 and the swing arm 19 contact against one another on a point. Furthermore, in the present embodiment, the protrusions 23 are formed in three parts. However, the protrusion 23 can be formed in four parts or more.

As shown in FIG. 7, the swing arm 19 formed as described above can swing vertically with the sun gear shaft 21 as the axis. When the swing arm 19 swings upward, the planet gear 20 meshes with the fuser drive input gear 17, and the drive force from the motor 14 can be transmitted to the fuser drive input gear 17 via the sun gear 18 and the planet gear 20. Meanwhile, when the swing arm 19 swings downward, the planet gear 20 and the fuser drive input gear 17 are released from the meshed state, and the drive force from the motor 14 to the fuser drive input gear 17 is cut off.

(Cartridge Drive Output Part)

As shown in FIG. 7, the cartridge drive output part 16 is provided at a position adjacent to the fuser drive output part 15 above the frame body 13. A slide gear is supported rotatable on the cartridge drive output part 16. The drive force from the motor 14 can be transferred constantly via the train of gears. In addition, a guide cover 43 covers a side of the cartridge drive output part 16. A guide groove 43*a* is formed on the cartridge cover 43 for guiding the circular guide 40 when setting the process cartridge 9. A drive force supplying shaft 242 having a projection 242*a* of the slide gear is protruding from a lower end part of the guide groove 43*a*. The guide groove 43*a* controls a direction in which the process cartridge 9 is inserted to the image forming apparatus. In addition, the drive force receiving shaft of the process cartridge 9 is positioned at approximately same position as the drive force supplying shaft 242 having a projection 242*a* of the slide gear.

Figure 9:
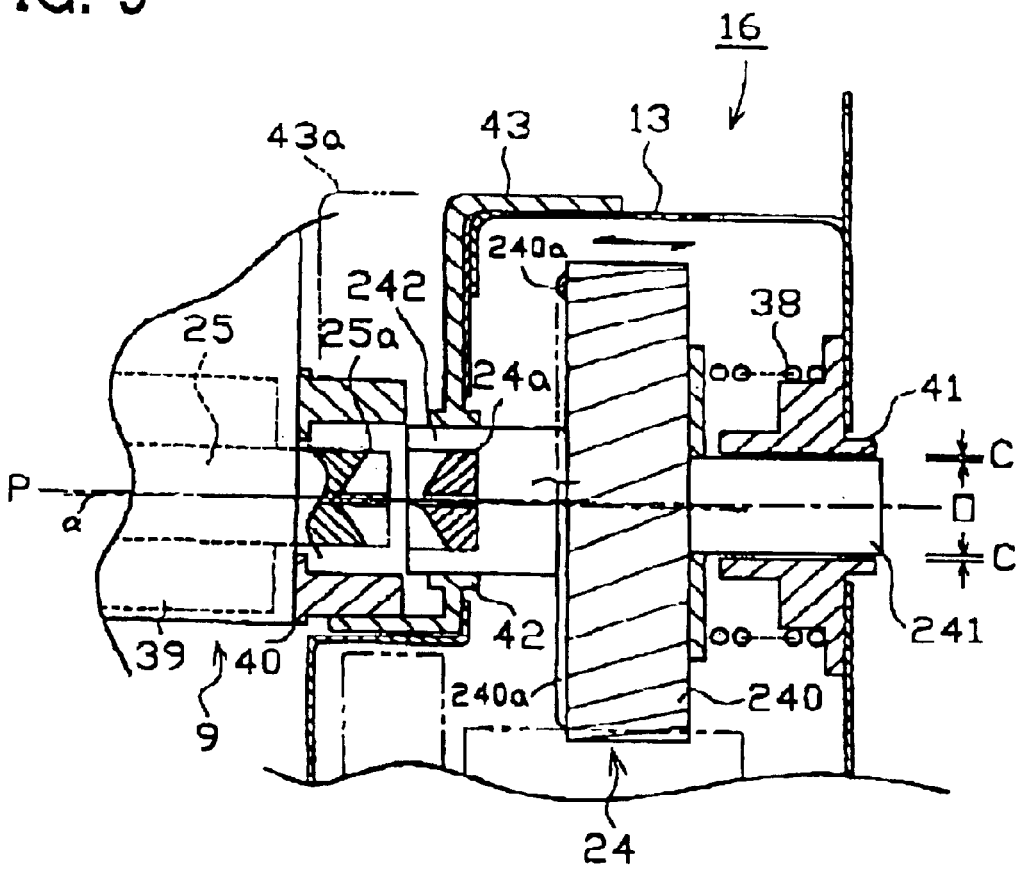
FIG. 9 is a cross-sectional view taken on line A—A of FIG. 7 under a state in which the process cartridge 9 is inserted.

FIG. 9 is a cross-sectional view taken on line A—A in FIG. 7. FIG. 9 shows a state in which the process cartridge 9 is inserted and the top cover 8 is opened. The slide gear is a helical gear formed integrally with shafts. That is, the drive force supplying shaft 241 is protruding to the opposite side of the guide cover 43 from the shaft center of the helical gear 240, and the drive force supplying shaft 242 having a projection 242*a* is protruding to the guide cover 43 side. The drive force supplying shaft 241 is supported rotatable by a first bearing 41 that is provided at a rear side (left side shown in the drawing) of the frame body 13. The drive force supplying shaft 242 having a projection 242*a* is supported rotatable by a second bearing 42 that is formed on the guide cover 43. Moreover, the first bearing 41 and the second bearing 42 are so-called sliding bearings. The drive force supplying shafts 241, 242 are supported slidable in a radial direction. The slide gear is urged in a direction toward the second bearing 42 by an compression spring 38 which is provided between the slide gear and the first bearing 41. By the sliding movement of the slide gear in the axial direction, the drive force from the slide gear is transferred to or cut off from the drive force receiving shaft of the process cartridge 9. In addition, by adopting the helical gear 240 for the slide gear, the slide gear can be rotated smoothly, and unevenness in the rotation of the photosensitive drum is controlled.

Figure 10:
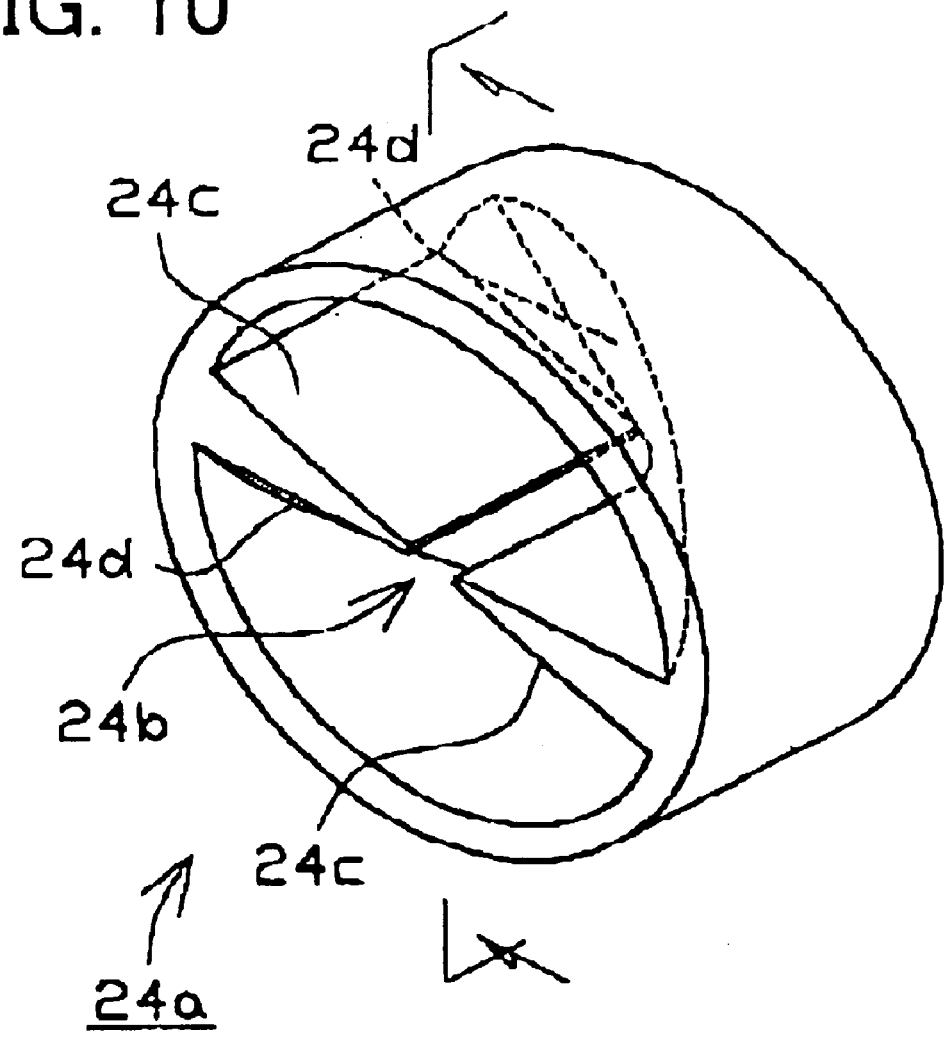
FIG. 10 is an enlarged perspective view showing a detailed configuration of a coupling part 24*a*.

A coupling part 24*a* is formed at an end part of the drive force supplying shaft 242 having a projection 242*a* of the slide gear. The coupling part 24*a* can be joined with or separated from the coupling part 25*a* of the process cartridge 9. As shown in FIG. 10, the coupling part 24*a* includes a core receptor which is formed at the shaft center of the slide gear. The core receptor can be joined with the core part 25*b* of the coupling part 25*a*. In addition, to be symmetrical with the shaft center as the center, two drive force supplying surfaces 24*c* are formed in a radial direction from the shaft center. Slanting surfaces 24*d* are formed in a slanting state from a tip end of one of the drive force supplying surfaces 24*c* toward a base end of the other drive force supplying surface 24*c* in a counterclockwise direction.

The coupling part 24*a* formed as described above can be joined with the coupling part 25*a* of the process cartridge 9 to transmit the drive force from the slide gear to the drive force receiving shaft. In detail, when the coupling part 24*a* of the slide gear and the coupling part 25*a* of the drive force receiving shaft of the process cartridge 9 are joined, the drive force supplying surface 24*c* of the coupling part 24*a* and the drive force receiving surface 25*c* of the coupling part 25*a* contact against one another. Accompanying the rotation of the slide gear, the drive force supplying surface 24*c* rotates while pushing the drive force receiving surface 25*c* of the drive force receiving shaft, and the drive force is transmitted to the drive force receiving shaft. By contacting the drive force supplying surface 24*c* and the drive force receiving surface 25*c* against one another as surfaces approximately perpendicular to the axial direction, in other words, to the rotational direction, a torque can be increased. As a result, load applied to the coupling parts 24*a*, 25*a* can be reduced, and the durability can be improved.

Moreover, the slanting surfaces 24*d* of the coupling part 24*a* and the slanting surfaces 25*d* of the coupling part 25*a* can contribute for the coupling part 24*a* and the coupling part 25*a* to be joined and separated smoothly. In detail, when the drive force is transferred, the drive force supplying surface 24*c* of the coupling part 24*a* and the drive force receiving surface 25*c* of the coupling part 25*a* are joined such that the surfaces contact against one another. However, the shaft center of the slide gear and the shaft center of the drive force receiving shaft are not necessarily located at a preferable position at all times. Therefore, when the coupling part 24*a* rotates accompanying the rotation of the slide gear, and the coupling part 24*a* reaches a position where the coupling part 24*a* can be joined with the coupling part 25*a* of the drive force receiving shaft, the coupling part 24*a* and the coupling part 25*a* are joined by the urging force of the compression spring 38. However, until reaching the position where the coupling part 24*a* can be joined with the coupling part 25*a*, an end surface of the coupling part 24*a* of the slide gear contacts against the slanting surface 25*d* of the coupling part 25*a* of the drive force receiving shaft, and slides over the slanting surface 25*d* accompanying the rotation of the slide gear to be guided to a position where the drive force supplying surface 24*c* and the drive force receiving surface 25*c* are engaged.

As described above, by provided the slanting surfaces 24*d* to the coupling part 24*a* and the slanting surfaces 25*d* to the coupling part 25*a*, the sliding movement of the slide gear is controlled until the slide gear urged by the compression spring 38 rotates to the position where the coupling part 24*a* can be joined with the coupling part 25*a*. The slide gear does not slide all of sudden at the position where the coupling part 24*a* can be joined with the coupling part 25*a*. The slide gear is guided to the position where the coupling part 24*a* can be joined with the coupling part 25*a*, while sliding gradually along the slanting surfaces 24*d*, 25*d* accompanying the rotation of the slide gear. Accordingly, the coupling parts 24*a*, 25*b* or the like can be prevented from being damaged by buffering shock that generate when the slide gear slides.

A diameter of a shaft hole of the first bearing 41 is formed slightly larger than a diameter of the drive force supplying shaft 241 of the slide gear. Therefore, a prescribed gap C is maintained between the first bearing 41 and the drive force supplying shaft 241. That is, the first bearing 41 only supports the drive force supplying shaft 241 softly, and does not position the drive force supplying shaft 241 strictly. Therefore, the slide gear is positioned mainly by the drive force supplying shaft 242 having a projection 242*a* and the second bearing 42. The slide gear is not positioned strictly by the first bearing 41 and the drive force supplying shaft 241. Thus, the axis line O of the slide gear can be slightly rotated eccentrically. Here, the gap C to be secured between the first bearing 41 and the drive force supplying shaft 241 is slightly larger than a gap that is generally provided for the bearing to support the shaft rotatable. For example, it is preferable to secure a gap which can permit the axis line O of the slide gear 24 to slant from a standard position (horizontal position) by an angle of eccentricity which is approximately tan−1 (1/100) (approximately 0.573 degrees). Moreover, it is preferable for a size of the gap C to be approximately 5/100 of the diameter of the drive force supplying shaft 241.

As described above, a prescribed gap C is formed between the first bearing 41 and the drive force supplying shaft 241, and the slide gear is supported by permitting the axis line O to rotate eccentrically. As a result, a displacement between the axis line O of the slide gear and an axis line P of the drive force receiving shaft of the process cartridge 9 as shown in FIG. 8 can be absorbed by a space permitting the slide gear to rotate eccentrically. Generally, the axis line O of the slide gear and the axis line P of the drive force receiving shaft of the process cartridge 9 are designed to be located on the same axis line. However, there are many cases when the axis line O of the slide gear is displaced from the axis line P of the drive force receiving shaft due to mistake of when assembling the drive unit 12 or the process cartridge 9. When the slide gear and the drive force receiving shaft are connected under a state in which the slide gear is displaced from the drive force receiving shaft, the coupling parts 24*a*, 25*a* can be damaged by unnatural force being applied to the coupling parts 24*a*, 25*a*. In addition, the photosensitive drum 39 can be caused to rotate eccentrically, and the recording image quality can be deteriorated.

Figure 11:
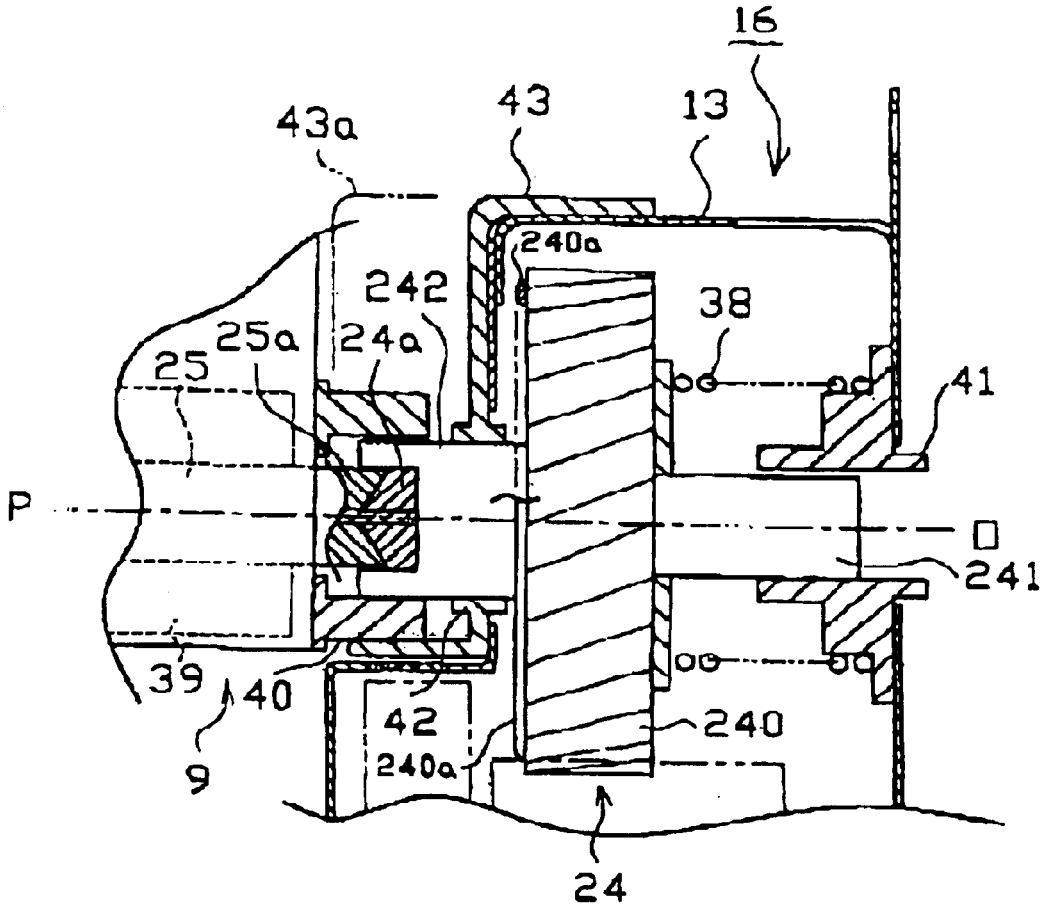
FIG. 11 is a cross-sectional view showing a state in which an axis line O of a slide gear is slanting to be joined together with the drive force receiving shaft of the process cartridge 9.

However, for example, as shown in FIG. 9, even in the case the axis line P of the drive force receiving shaft of the process cartridge 9 is slanting by an angle α from the standard position of the axis line O of the slide gear, since the slide gear 24 is permitted to rotate eccentrically by the gap C provided to the first bearing 41, when the coupling part 24*a* of the slide gear and the coupling part 25*a* of the drive force receiving shaft are joined, the slide gear is positioned by the joined part and the second bearing 42. Then, the axis line O of the slide gear also rotates eccentrically by the angle α. Accordingly, as shown in FIG. 11, the displacement between the axis line O of the slide gear and the axis line P of the drive force receiving shaft is solved. As a result, the coupling part 24*a* of the slide gear and the coupling part 25*a* of the drive force receiving shaft can be joined accurately. In addition, the photosensitive drum 39 can be prevented from being rotated eccentrically, and the coupling parts 24*a*, 25*a* can be prevented from being damaged due to unnatural joining of the coupling parts 24, 25*a*.

Figure 12:
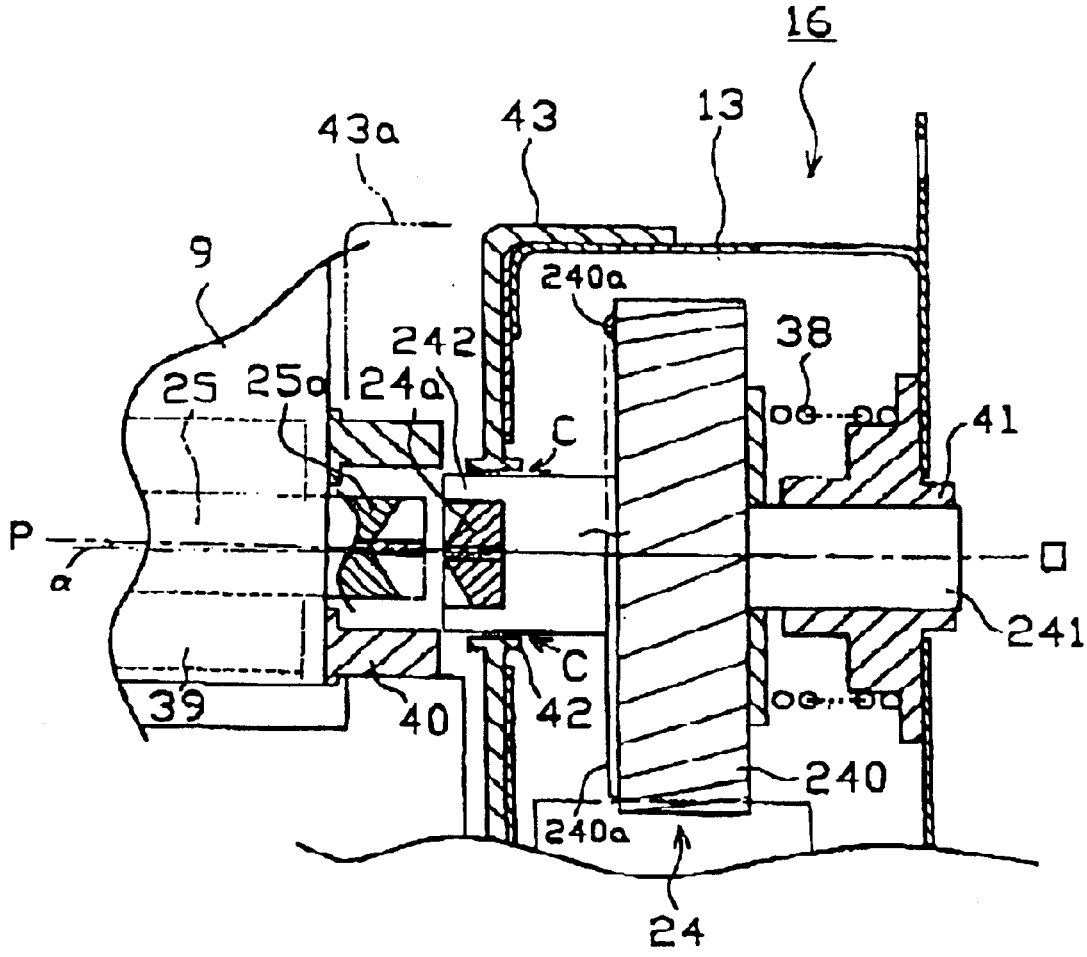
FIG. 12 is a cross-sectional view showing a configuration in which a gap C is provided to a second bearing 42.

Further, according to the present embodiment, the circular guide 40 of the process cartridge 9 is positioned by the guide groove 43*a* provided on the guide cover 43 of the drive unit 12. Since the position of the slide gear and the position of the drive force receiving shaft can be corresponded easily, the slide gear is positioned by the second bearing 42, and the gap C is provided to the first bearing 41. However, for example, as shown in FIG. 12, under a structure in which the circular guide 40 of the process cartridge 9 is positioned by the main body, the displacement between the slide gear and the drive force receiving shaft is prone to generate due to mistake in the assembling of the main body and the drive unit 12.

Figure 13:
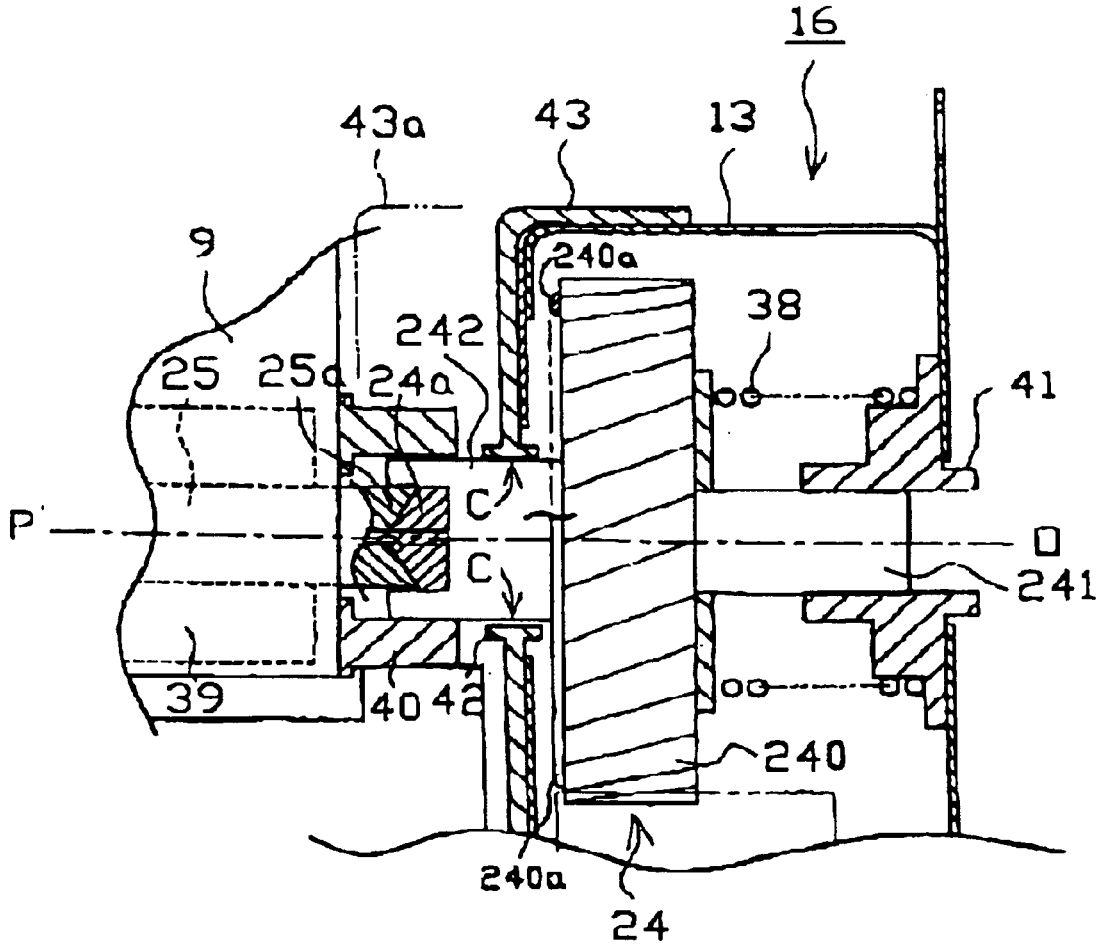
FIG. 13 is a cross-sectional view showing a state in which the axis line O of the slide gear is slanting to be joined together with the drive force receiving shaft of the process cartridge 9.

Therefore, there are cases when it is preferable to provide the gap C to the second bearing 42. That is, as shown in the drawing, the gap C is not provided to the first bearing 41, and the slide gear is position strictly by the first bearing 41. The gap C is provided to the second bearing 42, and a space is provided for the axis line O of the slide gear to rotate eccentrically. Accordingly, as shown in FIG. 13, the angle of eccentricity α formed by the joined coupling parts 24*a*, 25*a* is permitted by the gap C of the second bearing 42 with the first bearing 41 as the fulcrum. As a result, as shown in FIG. 9, the angle of eccentricity which can be permitted by the gap C can be enlarged than when the angle of eccentricity α is permitted by the gap C of the first bearing 41 with the second bearing 42 as the fulcrum.

Further, the determination for whether to provide the gap C to the first bearing 41 or to the second bearing 42 can be made in accordance with the above-described difference in the positioning of the process cartridge 9. In addition, the determination can be made in accordance with length of the drive force supplying shafts 241, 242, or relationship between the position of the first bearing 41 and the second bearing 42.

(Linkage Configuration of Both Output Parts)

Next, linkage configuration of the fuser drive output part 15 and the cartridge drive output part 16 will be described. The swing arm 19 of the fuser drive output part 15 and the slide gear of the cartridge drive output part 16 are linked by a cam mechanism to be described later on. When the drive force is not transmitted from the fuser drive output part 15 to the fuser drive input gear 17, the drive force is not transmitted from the cartridge drive output part 16 to the drive force receiving shaft.

Figure 14:
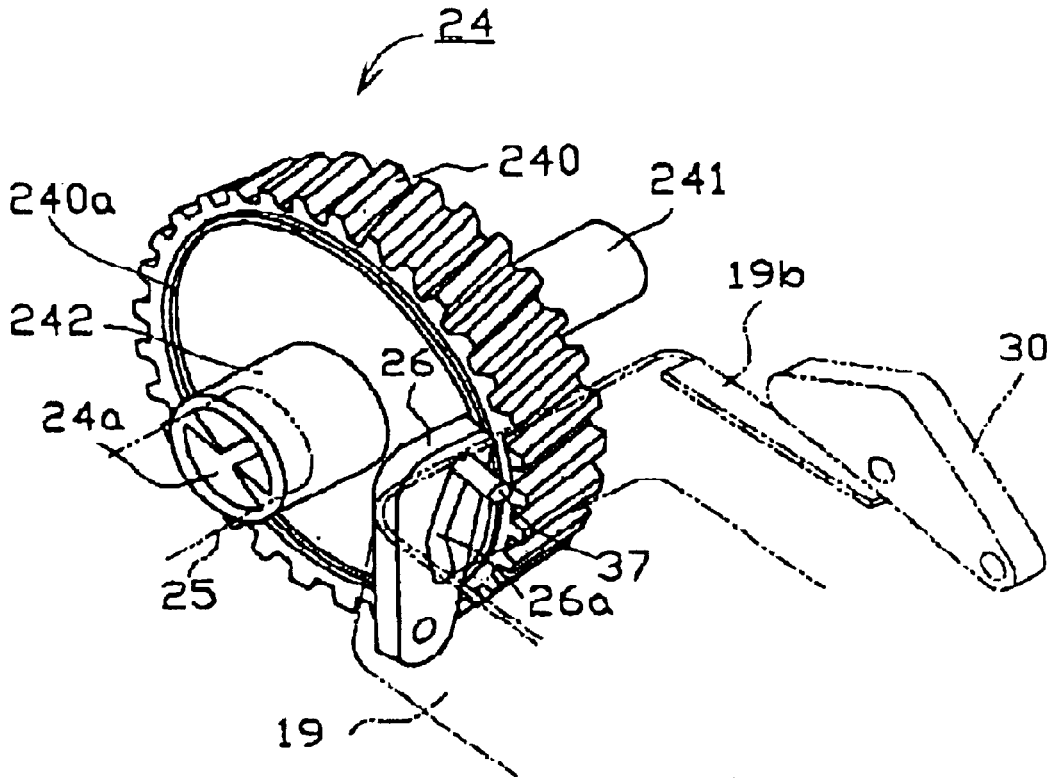
FIG. 14 is a perspective view showing a configuration of a pushing cam 26 which slides the slide gear.

The cam mechanism will be described in details with reference to the drawings. As shown in FIG. 6A, FIG. 6B, and FIG. 14, a pin 37 is protruding from a free end surface of the swing arm 19 of the fuser drive output part 15. A pushing cam 26 is provided in proximity to the free end surface of the swing arm 19. In addition, the pushing cam 26 is provided in an upright state with a lower end pivotally supported such that the pushing cam 26 can contact against or separate from the side of the helical gear 240 of the slide gear. As shown in FIG. 14, a cam groove 26*a* is formed on the pushing cam 26. The cam groove 26*a* is long lengthwise, and has a shape like a dogleg. The pin 37 is inserted in the cam groove 26*a*.

Figure 15:
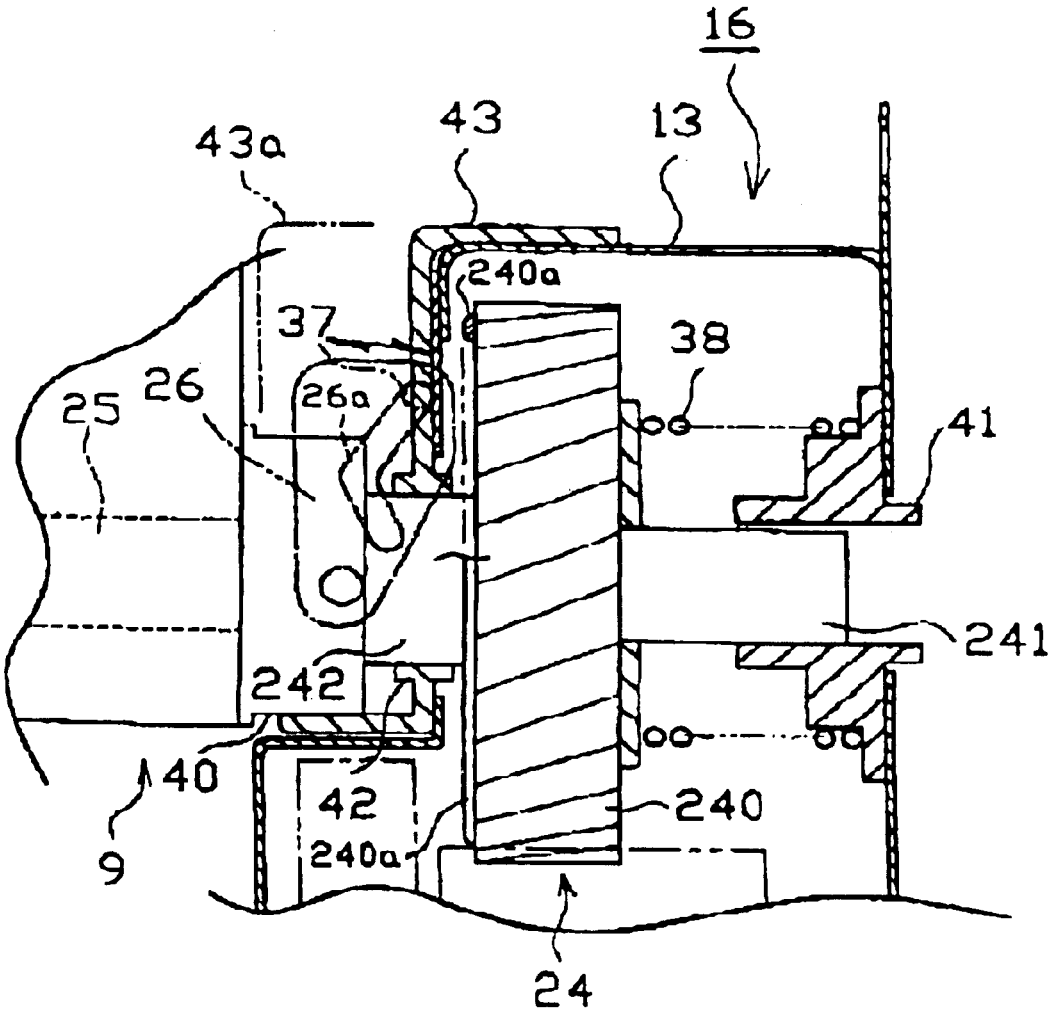
FIG. 15 is a cross-sectional view showing a configuration of the pushing cam 26 which slides the slide gear.

Meanwhile, as shown in FIG. 15, a circular reinforcement rib 240*a* is formed in a peripheral direction on the side of the helical gear 240. The pushing cam 26 can contact against the reinforcement rib 240*a*. The reinforcement rib 240*a* prevents the pushing cam 30 from being damaged by contacting against a tooth part of the helical gear 240 when the pushing cam 30 contacts against the slide gear. In addition, the reinforcement rib 240*a* prevents the slide gear from being rotated unevenly due to imperfect meshing. Further, the shape of the reinforcement rib 240*a* is not limited in particular. However, the reinforcement rib 240*a* is preferable to have a trapezoid semicircular shape in the cross-section.

FIG. 14 and FIG. 15 show a state in which the fuser drive output part 15 is transmitting the drive force to the fuser drive input gear 17, and the cartridge drive output part 16 is transmitting the drive force to the drive force receiving shaft of the process cartridge 9. Under this state, as shown in FIG. 14, the swing arm 19 of the fuser drive output part 15 swings upward, the planet gear 20 (not shown in the drawing) meshes with the fuser drive input gear 17 to transmit the drive force from the motor 14. Under a state in which the swing arm 19 is swung upward, the pin 37 is located in proximity to the uppermost end of the cam groove 26*a* of the pushing cam 26. As shown with a double dashed line in FIG. 15, the pin 37 is located away from the slide gear. Therefore, the slide gear slides to the process cartridge 9 side by the urging force of the compression spring 38, and as described above, the slide gear is linked to the drive force receiving shaft of the process cartridge 9 to transmit the drive force.

Figure 16:
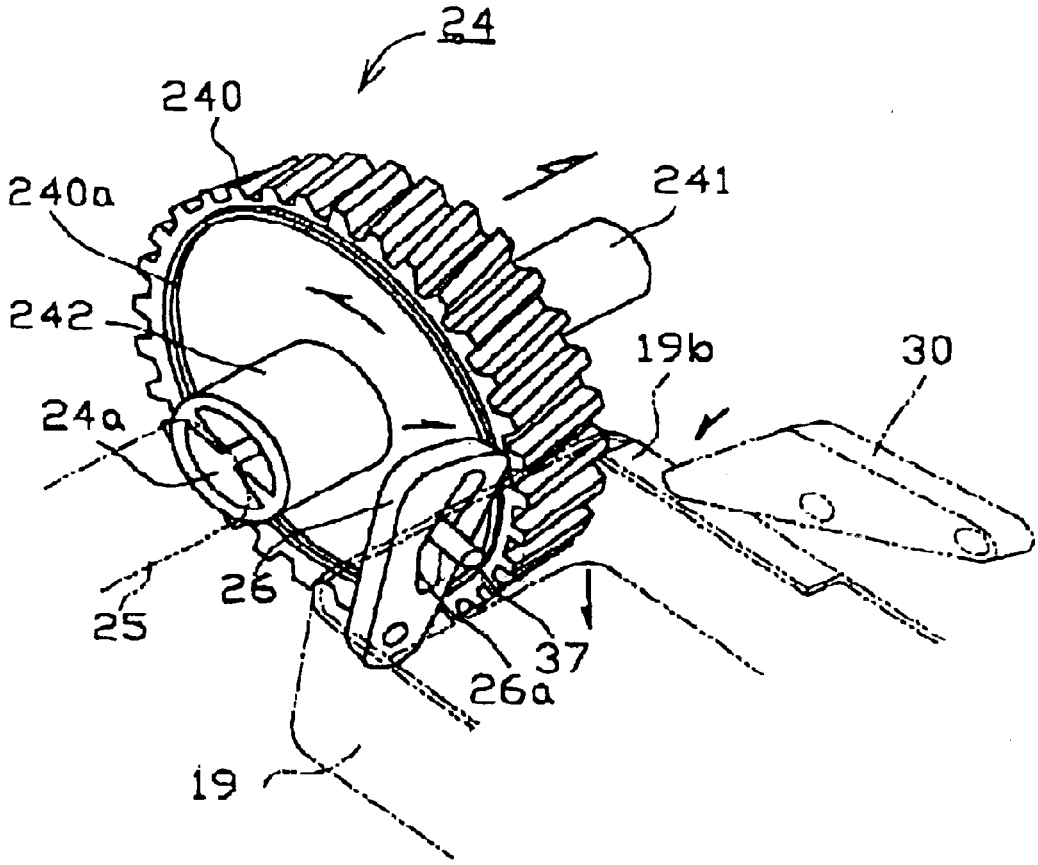
FIG. 16 is a perspective view showing a state in which the pushing cam 26 pushes to slide the slide gear.
Figure 17:
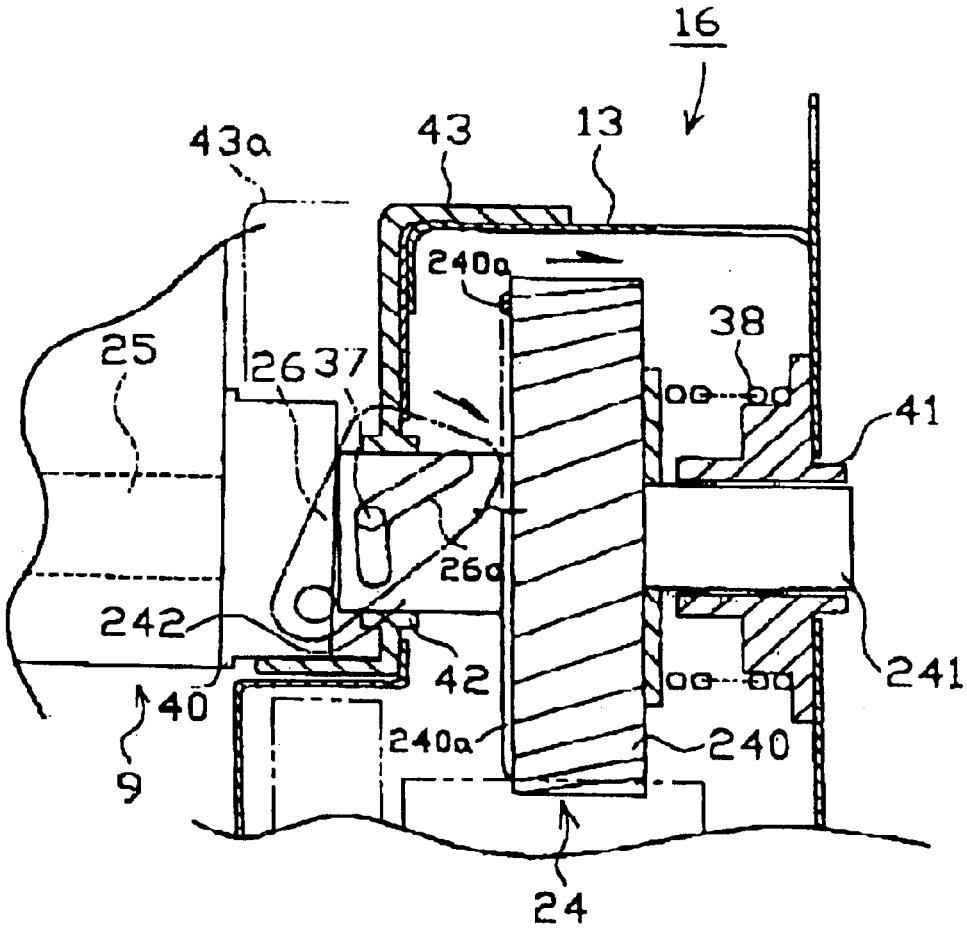
FIG. 17 is a cross-sectional view showing a state in which the pushing cam 26 pushes to slide the slide gear.

Meanwhile, FIG. 16 and FIG. 17 show a state in which the drive force is not transmitted from the fuser drive output part 15 to the fuser drive input gear 17, and the drive force is not transmitted from the cartridge drive output part 16 to the drive force receiving shaft of the process cartridge 9. As shown in FIG. 16, the swing arm 19 is Swung downward by the pushing surface 19*b* of the swing arm 19 being pushed by a cam 30 to be described later on. Accordingly, the planet gear 20 (not shown in the drawing) and the fuser drive input gear 17 are separated, and the drive force from the motor 14 is cut off from being transmitted. Moreover, when the swing arm 19 swings downward, the pin 37 that is provided on the free end surface of the swing arm 19 also moves downward. In addition, the pushing cam 26 is inclined to the direction of the slide gear. Accordingly, as shown in FIG. 17, the pushing cam 26 contacts against the reinforcement rib 240*a* of the slide gear, and the slide gear is pushed to the direction of the first bearing 41 against the urging force of the compression spring 38. When the slide gear is slid to the direction of the first bearing 41, the slide gear is separated from the drive force receiving shaft of the process cartridge 9, and the drive force is cut off from being transmitted to the drive force receiving shaft.

Here, the slide gear is formed by the helical gear 240. Therefore, as shown in FIG. 16, when sliding toward the direction of the first bearing 41, the slide gear rotates slightly to a direction opposite to the rotational direction (counterclockwise direction in FIG. 16) along the mesh between the slide gear and the train of gears (not shown in the drawing) which are meshed at all times to transmit the drive force from the motor 14. As described above, the slide gear separates from the drive force receiving shaft while the drive force supplying surface 24*c* of the coupling part 24*a* of the slide gear rotates in a direction to separate from the drive force receiving surface 25*c* of the coupling part 25*a* of the drive force receiving shaft. Therefore, the coupling part 24*a* of the slide gear can be separated smoothly from the coupling part 25*a* of the drive force receiving shaft. Moreover, in the coupling part 24*a*, the slanting surface 24*d* is formed between the drive force supplying surfaces 24*c*, and in the coupling part 25*a*, the slanting surface 25*d* is formed between the drive force receiving surfaces 25*c*. Therefore, a reverse rotation of the slide gear is not disturbed.

Further, when the pushing force of the cam 30 to swing the swing arm 19 downward is released, the slide gear slides toward a direction of the second bearing 42 by the urging force of the compression spring 38. As a result, the pushing cam 26 is pushed backward to uprise, and an upward force is applied to the pin 37 by a cam function of the cam groove 26*a* of the pushing cam 26, and the swing arm 19 swings upward. As described above, the compression spring 38 also functions as a return spring to push back the downward swing of the swing arm 19. Therefore, when the cam 30 does not push the swing arm 19 downward, the swing arm 19 swings upward, and the drive force is transmitted to the fuser drive input gear 17.

(Configuration to Transmit/Cut Off Drive Force According to Opened or Closed State of Top Cover)

Next, the cam mechanism 27 which links the top cover 8 and the swing arm 19 of the fuser drive output part 15 will be described. By linking the swing arm 19 to the top cover 8 via the cam mechanism 27 to be described below, when the top cover 8 is opened, the swing arm 19 is pushed by the cam 30 and swung downward. When the swing arm 19 is swung downward, the drive force is prevented from being transmitted between the fuser drive output part 15 and the fuser drive input gear 17. In addition, the drive force is prevented from being transmitted between the cartridge drive output part 16 and the drive force receiving shaft of the process cartridge 9. Accordingly, as shown in FIG. 4 and FIG. 5, the setting and removing of the process cartridge 9, and the eliminating of the paper jam can be carried out easily. Meanwhile, when the top cover 8 is closed, the pushing by the cam 30 is released, and as described above, the swing arm 19 swings upward to become capable of transmitting the drive force to the fuser drive input gear 17. In addition, the slide gear becomes capable of transmitting the drive force to the drive force receiving shaft of the process cartridge 9.

Figure 18:
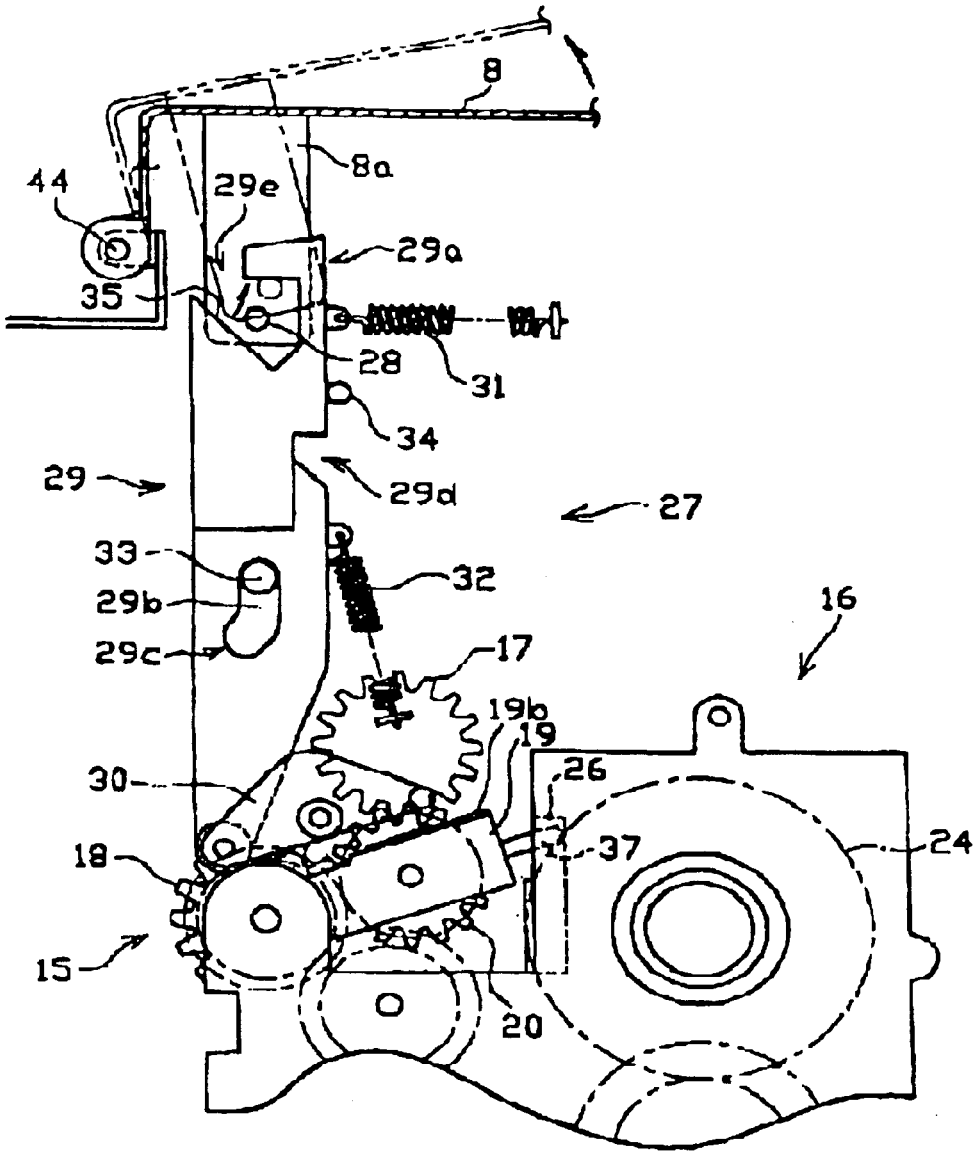
FIG. 18 is a side view showing a configuration of a cam mechanism 27 which links the top cover 8 and a swing arm 19.

FIG. 18 is a side view showing a configuration of the cam mechanism 27. The cam mechanism 27 is provided between the drive unit 12 and the top cover 8 which is pivotally supported by the support shaft 44 to be openable or closable. In detail, the cam mechanism 27 includes a lever 29 and the cam 30. The lever 29 includes a hook part 29*a* which can join with the pin 28 provided on the top cover 8. The cam 30 is provided at a lower end of the lever 29.

The pin 28 of the top cover 8 is protruding laterally from proximity of a lower end of a bracket 8*a* which is dropping from a ceiling surface of the top cover 8 (side facing toward an inner side of the image recording unit 2). The pin 28 moves when the top cover 8 is opened or closed. Moreover, the lever 29 is provided such that longitudinal direction of the lever 28 becomes vertical direction. A hook part 29*a* is formed in an upper part of the lever 29. A long hole 29*b* is formed in approximately a center part of the lever 29. A concave part 29*d* is formed at an edge of the center part of the lever 29.

The apparatus front side of the upper end of the lever 29 is shaped hook-like to form the hook part 29*a*. Meanwhile, an opening part 29*e* is formed at the apparatus back side with an upper part opened. Furthermore, at the apparatus back side, a slanting part 35 is formed approximately opposing against the hook part 29*a*, slanting downward toward the apparatus front side. The hook part 29*a* can be joined with the pin 28 of the top cover 8. Meanwhile, the pin 28 can pass through the opening part 29*e*. That is, when the top cover 8 is opened, the pin 28 is joined with the hook part 29*a* to pull the lever 29 upward. Then, when the lever 29 is slanted down to the apparatus front side, the pin 28 passes through the opening part 29*e*, and the link between the top cover 8 and the lever 29 is released. Meanwhile, when closing the top cover 8, the pin 28 contacts against the slanting part 35 to push down the lever 29 to the apparatus back side.

A support pin 33, which is provided to the image recording unit 2, is inserted through the long hole 29*b* that is formed in proximity to the center of the lever 29. The support pin 33 supports the lever 29. The long hole 29*b* is formed in a vertical direction. A free part 29*c* is formed at the lower end of the long hole 29*b*. The free part 29*c* is slanting toward the apparatus back side, and has a wide width. Therefore, the lever 29 can move vertically along the long hole 29*b* and the shape of the free part 29*c*. Moreover, when the support pin 33 is inserted into the free part 29*c*, the lever 29 can swing with the linked part with the cam 30 as approximately the center.

Two tension springs 31, 32 are provided between the lever 29 and the image recording unit 2 main body. The lever 29 is urged to the apparatus front side by the first tension spring 31, and approximately downward by the second tension spring 32. The lever 29 urged to the apparatus front side by the first tension spring 31 contacts against a stopper 34 provided to the image recording unit 2 at the edge part of the lever 29. As a result, the movement of the lever 29 toward the apparatus front side is controlled. Furthermore, when the lever 29 is urged approximately downward by the second tension spring 32, the support pin 33 is contacted against the upper end of the long hole 29*b*. Moreover, under a state in which the support pin 33 is located at the lower end of the free part 29*c*, the stopper 34 moves into the concave part 29*d* to slant the lever 29. Further, the concave part 29*d* is formed on an edge of the lever 29.

The cam 30 is approximately isosceles triangle shaped. Approximately the center of the lower part of the cam 30 is pivotally supported directly above the swing arm 19 of the fuser drive output part 15. An edge of the cam 30 at the apparatus inner side is pivotally connected to the lever 29. By the vertical movement of the lever 29, the cam 30 moves like a seesaw. As described above, the other end of the cam 30 pushes down the pushing surface of the swing arm 19.

Next, a movement of the cam mechanism 27 will be described. First, under a state in which the top cover 8 is closed, as shown in FIG. 18, the pin 28 which is provided to the top cover 8 is located inside the hook part 29*a* of the lever 29. The lever 29 is urged to the apparatus front side by the first tension spring 31 to contact against the stopper 34. Then, the lever 29 is urged approximately downward by the second tension spring 32, and the support pin 33 is contacted against the upper end of the long hole 29*b*. At this time, the lever 29 is pulling the connected part between the lever 29 and the cam 30 downward, and the cam 30 is not contacting against the pressing surface 19*b* of the swing arm 19. Therefore, as described above, the swing arm 19 swings upward by a force which the compression spring 38 (not shown in the drawing) urges the slide gear. Then, the planet gear 20 and the fuser drive input gear 17 are meshed, and the drive force from the motor 14 (not shown in the drawing) can be transmitted to the fuser 11 (not shown in the drawing) via the fuser drive input gear 17. Moreover, the slide gear joins with the drive force receiving shaft (not shown in the drawing) of the process cartridge 9, and the, drive force of the motor 14 can be transmitted to the process cartridge 9.

Figure 19:
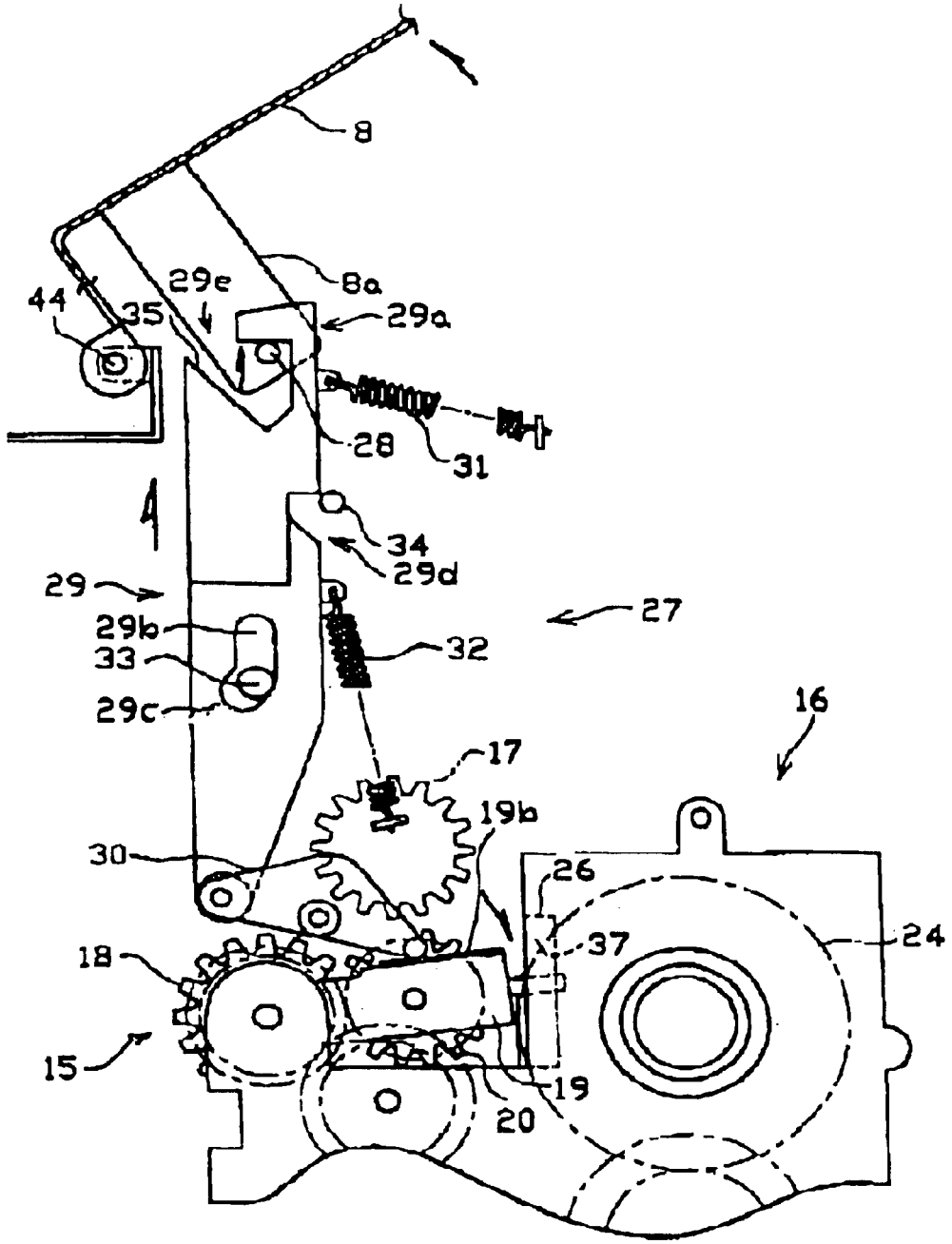
FIG. 19 is a side view showing a state in which the top cover 8 is opened and the swing arm 19 is swung downward.

From this state, when the top cover 8 is pulled upward to be opened, as shown in FIG. 19, the pin 28 joins with the hook part 29*a* of the lever 29. The hook part 29*a* is pulled upward by following the movement of the top cover 8, and the lever 29 transfers upward while guided by the long hole 29*b* and the support pin 33. When the lever 29 transfers upward, the cam 30 which is pivotally connected to the lower end of the lever 29 is also pulled upward, and the cam 30 moves like a seesaw to descend the other end. The other end pushes up the pushing surface 19*b* of the swing arm 19, and the swing arm 19 is swung downward. Accordingly, the planet gear 20 and the fuser drive force input gear 17 are separated, and the drive force is cut off from being transmitted to the fuser drive force input gear 17. Moreover, as described above, accompanying the downward swing of the swing arm 19, the pushing cam 37 slides the slide gear, and the slide gear and the drive force receiving shaft of the process cartridge 9 are released from the joined state.

Figure 20:
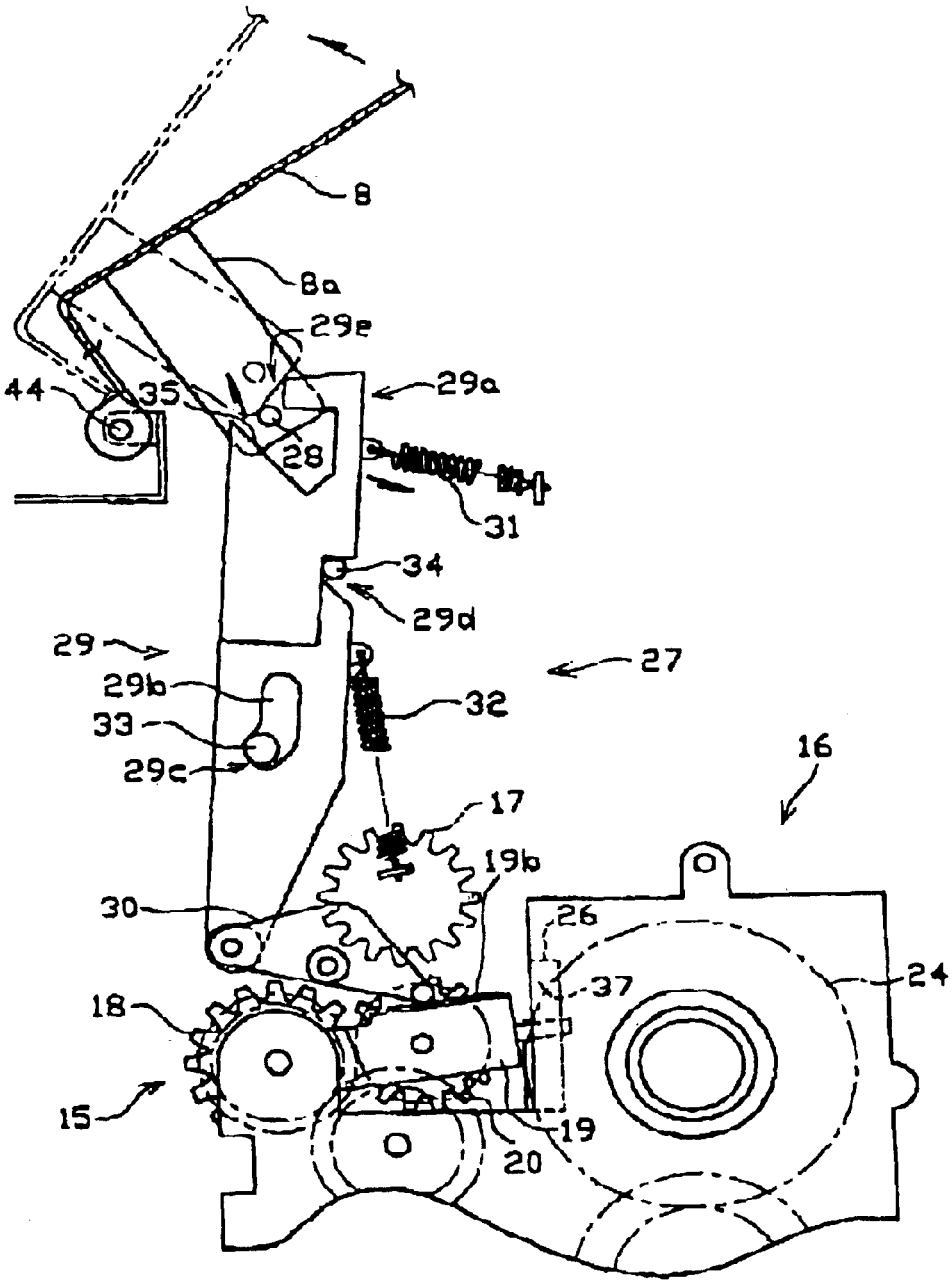
FIG. 20 is a side view showing a state in which the swing arm 19 is swung downward and locked.

Furthermore, accompanying the upward movement of the top cover 8, the lever 29 also moves upward, and the concave part 29*d* formed at an edge of the lever 29 reaches the position facing the stopper 34. FIG. 19 shows a state directly before the stopper 34 enters into the concave part 29*d*. Subsequently, the lever 29 is slanted down to the apparatus front side by the urging force of the first tension spring 31 with the connected part between the lever 29 and the cam 30 as approximately the center. Then, as shown in FIG. 20, the stopper 34 enters into the concave part 29*d*, and the downward slanting movement of the lever 29 is completed. Moreover, when the stopper 34 enters into the concave part 29*d*, the vertical movement of the lever 29 is locked. Accompanying this, the cam 30 is also locked under a state in which the cam 30 is pushing the swing arm 19 downward.

Meanwhile, by the lever 29 being slanted down, the hook part 29*a* and the pin 28 are released from the joined state, and the pin 28 is located at the opening part 29*e*. Accordingly, when the top cover 8 is further pulled upward, the pin 28 passes through the opening part 29*e*, and the pin 28 can be detached from the inner side of the hook part 29*a*. As a result, the connection between the top cover 8 and the lever 29 is released, and the top cover 8 can be opened widely to its limit. Therefore, the process cartridge 9 can be set or removed easily, and the paper jam can be eliminated easily.

Figure 21:
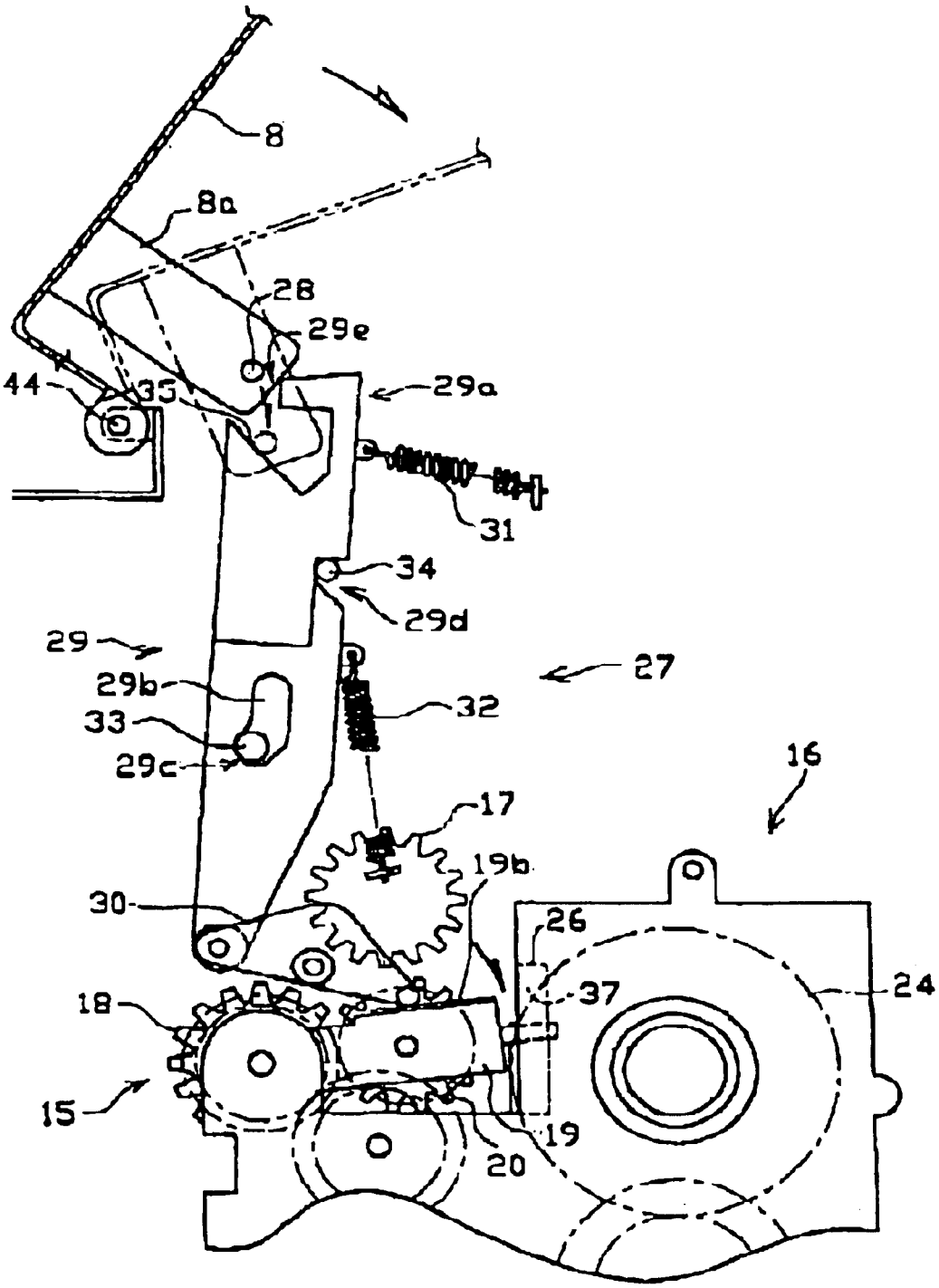
FIG. 21 is a side view showing a state in which the top cover 8 is closed and a lever 29 is returned to an original position.
Figure 22:
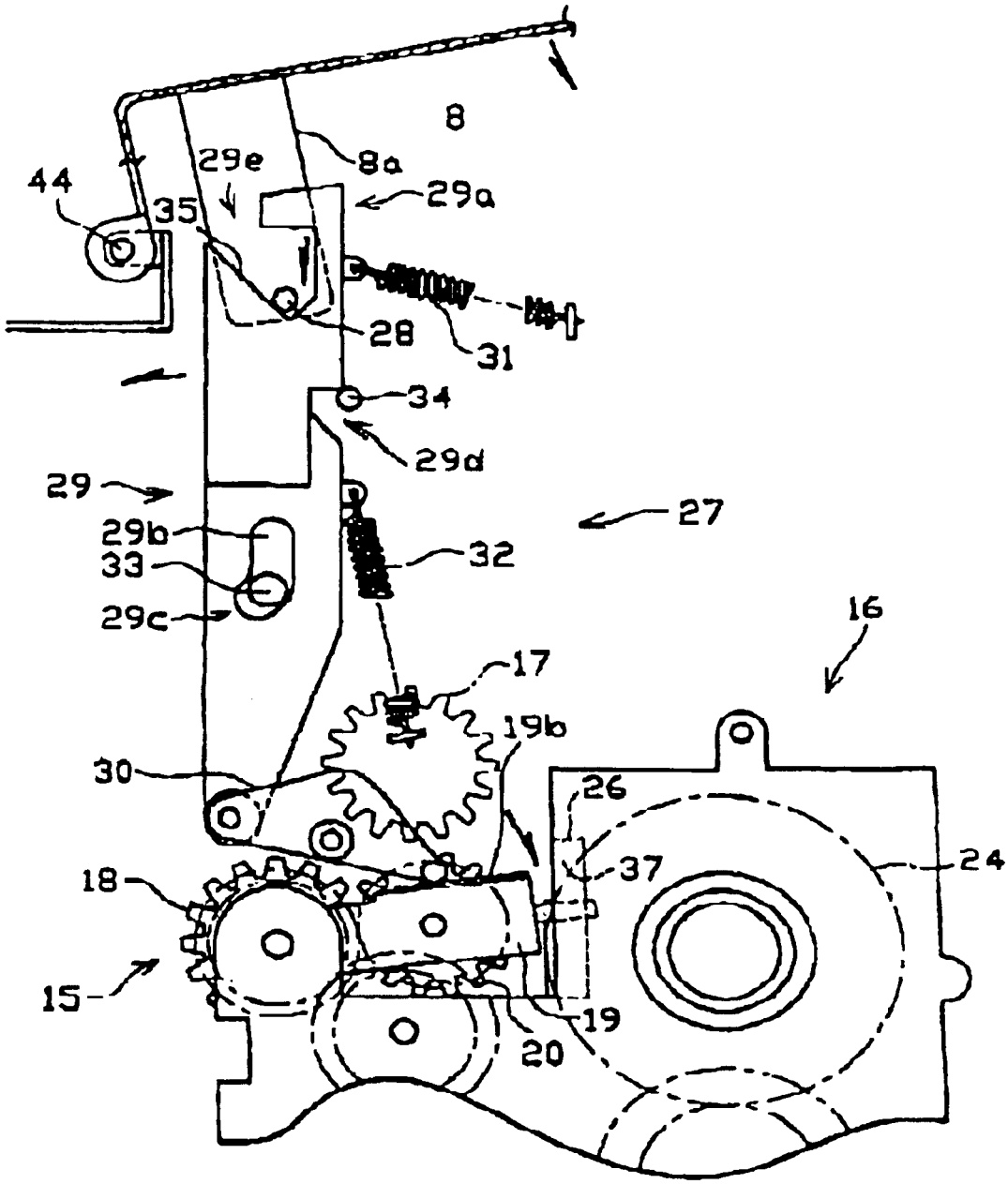
FIG. 22 is a side view showing a state in which the lever 29 is swung.

Next, an operation of when closing the top cover 8 will be described. As shown in FIG. 21, when the top cover 8 is pulled downward from a state in which the top cover 8 is opened in proximity to its limit, the pin 28 enters into the inner side of the hook part 29*a* from the opening part 29*e* of the lever 29. Then, the pin 28 contacts against the slanting part 35. When the top cover 8 is further pushed downward, as shown in FIG. 22, the pin 28 pushes the slanting part 35 to the apparatus back side while sliding over the slanting part 35. The lever 29 swings to the apparatus back side against the urging force of the first tension spring 31, with the connection between the lever 29 and the cam 30 as approximately the center. Accordingly, the concave part 29*e* at the edge of the lever 29 departs from the stopper 34, and the lever 29 and the stopper 34 are released from the joined state.

Figure 23:
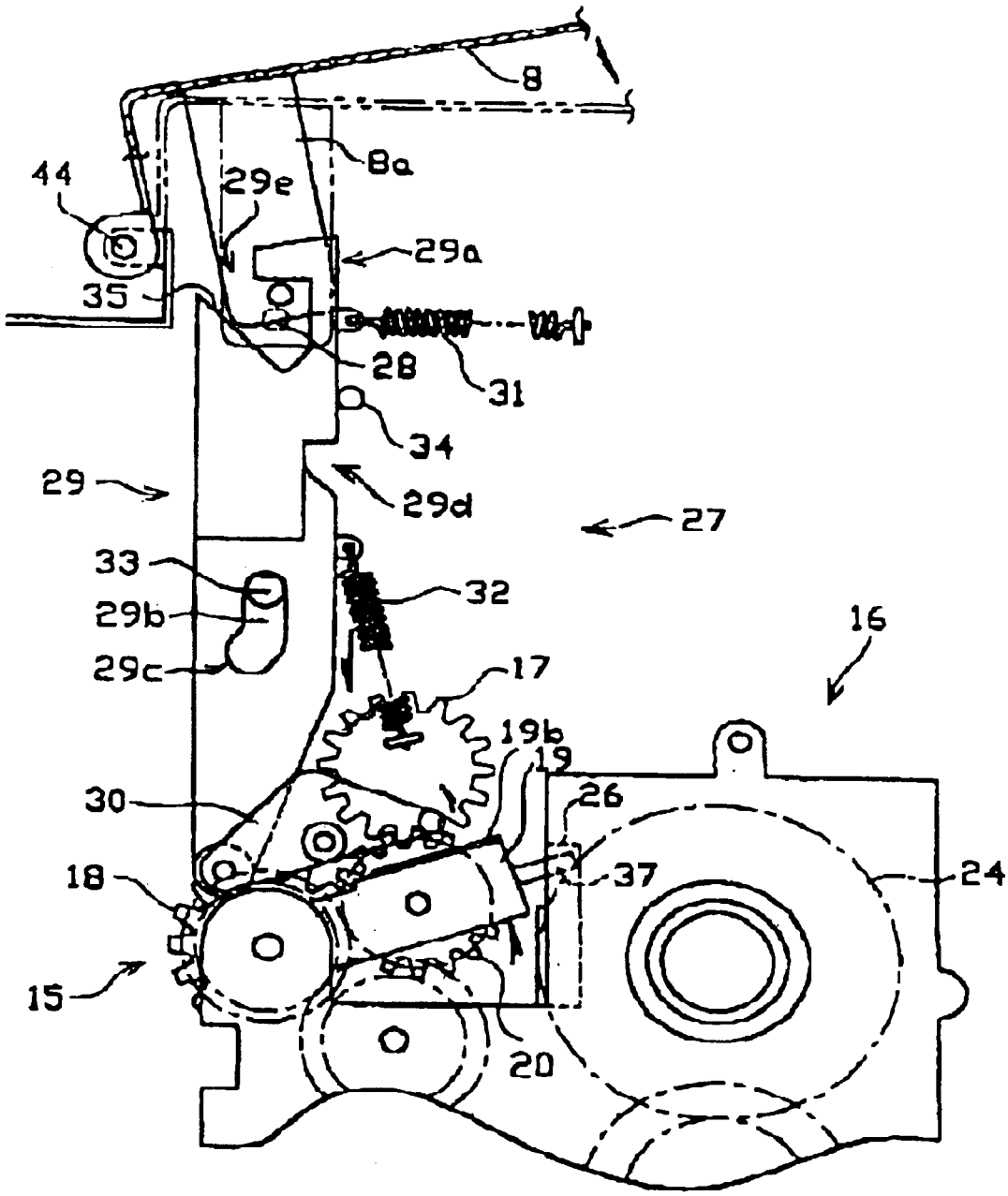
FIG. 23 is a side view showing a state in which the top cover 8 is closed and the swing arm 19 is swung upward.

FIG. 22 shows a state directly before the joined state is released. Subsequently, the lever 29 which is released from the joined state with the stopper 34 transfers downward while guided by the long hole 29*b* and the support pin 33 by following the urging force of the second tension spring 32. Then, as shown in FIG. 23, the support pin 33 is contacted against the upper end of the long hole 29*b*. Accompanying the descend of the lever 29, the connected part between the lever 29 and the cam 30 is pulled down, and the cam 30 moves like a seesaw to elevate the other end. Accordingly, the pushing movement of the swing arm 19 is released. Then, as described above, the swing arm 19 swings upward, and the drive force can be transmitted to the fuser drive input gear 17. In addition, the slide gear can transmit the drive force to the drive force receiving shaft of the process cartridge 9.

As described above, the swing arm 19 is swung by the cam mechanism 27 when the top cover 8 is opened or closed. Under a state in which the top cover 8 is opened, the drive force is cut off from being transmitted to the fuser drive input gear 17 and the drive force receiving shaft of the process cartridge 9. As a result, the process cartridge 9 can be set or removed easily. In addition, since the fuser 11 can be rotated freely, the maintenance such as elimination of the paper jam can be carried out easily. Meanwhile, under a state in which the top cover 8 is closed, the drive force can be transmitted to the fuser 11 and the process cartridge 9.

Moreover, when opening and closing the top cover 8, the top cover 8 and the lever 29 are linked only under a state in which the pin 28 provided to the top cover 8 is joined with the hook part 29*a* of the lever 29. When the top cover 8 is completely closed or opened, the pin 28 and the hook part 29*a* are not joined, and the linked state is released. Accordingly, no force is applied to the pin 28 and the hook part 29*a* which link the top cover 8 and the lever 29, other than when opening an closing the top cover 8. Therefore, the pin 28 and the hook part 29*a* are not required to have strong strength. Thus, it is not necessary to use a strong and expensive material for the pin 28 and the hook part 29*a*. In addition, it is not necessary to provide a reinforcement member, and a cost can be reduced.

(Configuration to Attach Drive Unit to Image Forming Apparatus)

Figure 24:
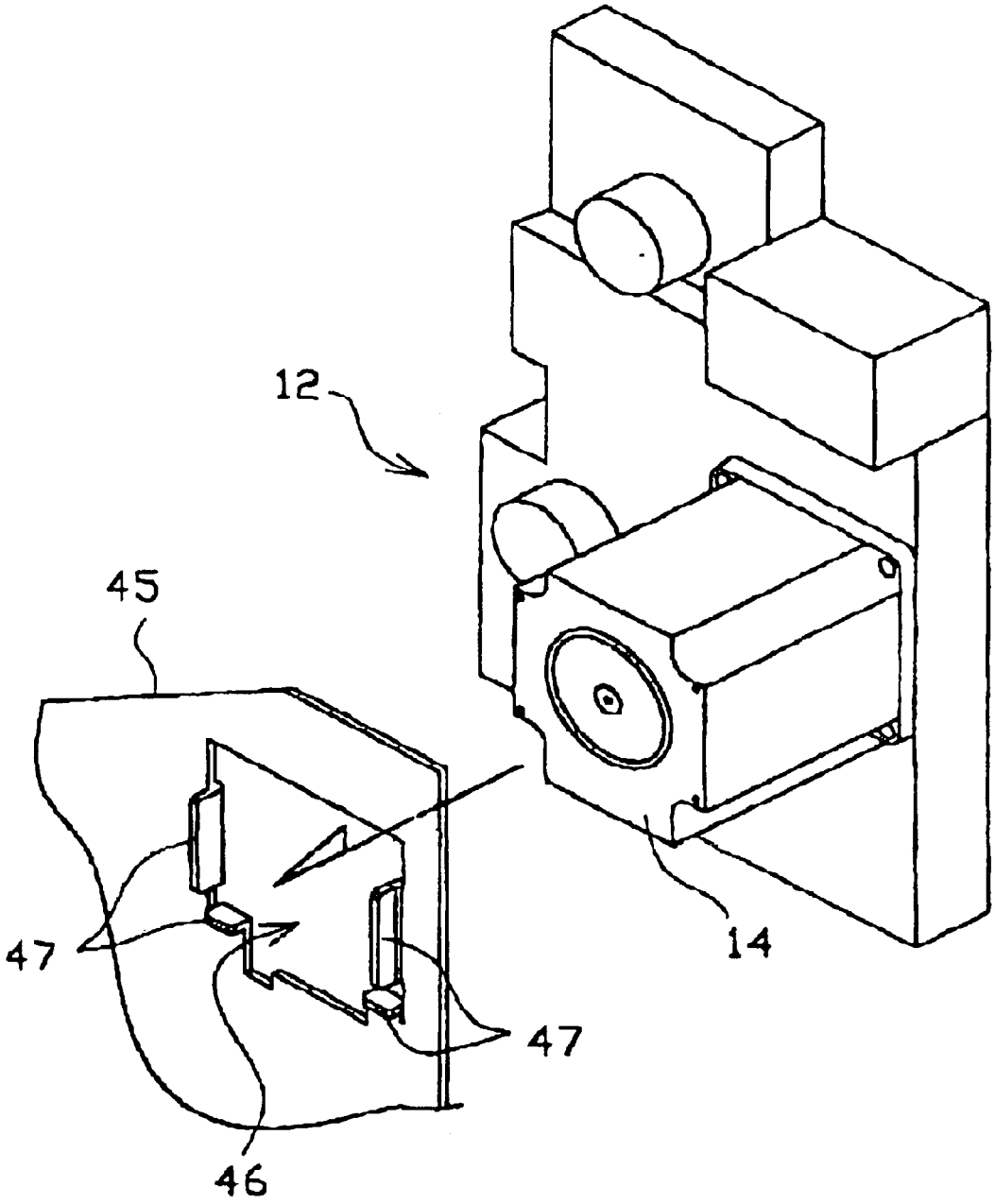
FIG. 24 is a perspective view showing a method to mount a drive unit 12 to the image recording unit 2.
Figure 25:
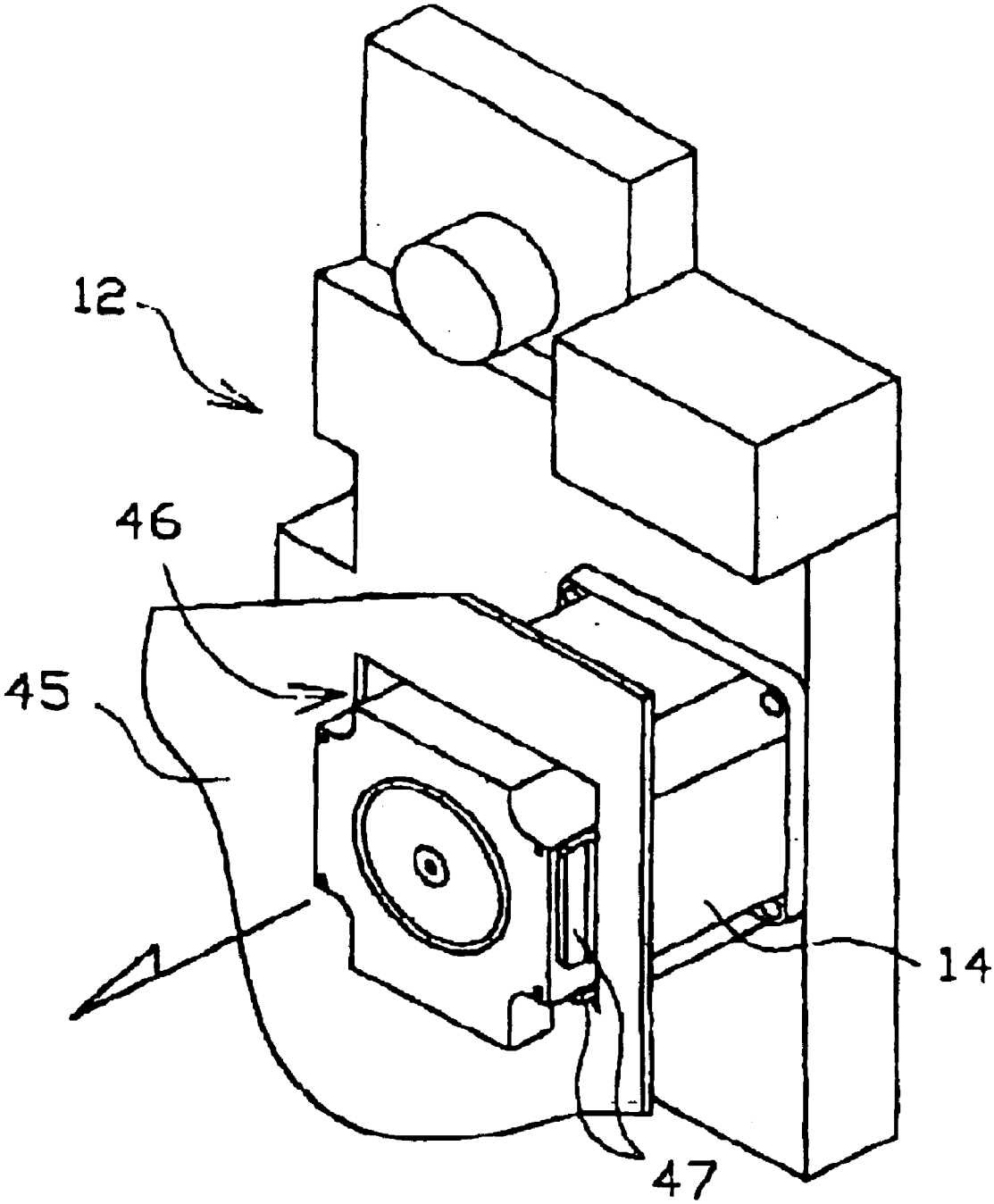
FIG. 25 is a perspective view showing a method to mount the drive unit 12 to the image recording unit 2.

FIG. 24 and FIG. 25 are perspective views showing a method to attach the drive unit 12 to the image recording unit 2. As described above, the motor 14 is fixed in a cantilever on the drive unit 12. The motor 14 is generally heavy load, and for many cases, the motor 14 is occupying a greater part of the total weight of the drive unit 12. Therefore, a center of gravity of the drive unit 12 is slanted, and the drive unit 12 is not balanced. Thus, it is difficult for the drive unit 12 to maintain an upright state. However, it is necessary to attach the drive unit 12 to the main body under an upright state. As a result, there is difficulty in attaching the drive unit 12 to the image recording unit 2.

In consideration to the above-described circumstance, a through hole 46 is formed on a main body frame 45 of the image recording unit 2 for setting the motor 14. The main body frame 45 is formed from sheet metal. Plate shaped guides 47 are provided around the through hole 46, specifically at both sides and lower side of the through hole 46. The guides 47 are protruding toward the inner side of the apparatus to guide the sides and the lower surface of the motor 14. When attaching the drive unit 12, first, as shown in FIG. 24, the motor 14 is inserted though the through hole 46 from the outer side of the main body frame 45. Then, as shown in FIG. 25, the motor 14 is placed on the guide 47 of the lower surface such that the weight of the motor 14 is accepted by the main body frame 45. Accordingly, the drive unit 12 can be maintained under upright state easily.

Moreover, from a state shown in FIG. 25, the frame body 13 of the drive unit 12 is attached to the main body frame 45 by sliding the motor 14 along the guides 47. Then, the drive unit 12 is fixed to the main body frame 45 by a screw (not shown in the drawing). By adopting such a simple attaching method, the attaching steps can be reduced.

Further, the guides 47 are formed by leaving the guide parts when stamping the through hole 46 of the main body frame 45, and bending the guide parts toward the inner side of the image recording unit 2. Accordingly, the parts protruding to the outside of the image forming apparatus can be reduced, and the size of the image forming apparatus can be reduced. In addition, since the direction in which the guides 47 are bent is corresponding to the direction in which the motor 14 is inserted, the motor 14 can be inserted smoothly. Furthermore, the through hole 46 is formed in square and the guides 47 are formed in tabular shape to correspond to the shape of a casing of the motor 14 which is approximately rectangular parallelepiped.

In the above described embodiment, the slide gear 24 is formed as the coupling protrusion and the photosensitive drum 39 is formed as the coupling hole. However, the present invention is not limited to this example, and for example, the slide gear 24 can be formed as the coupling hole and the photosensitive drum 39 can be formed as the coupling protrusion.

The present invention is not limited to the above-described embodiment, but includes variations or modifications within the technical concept.

What is claimed is:

1. An image forming system having a process cartridge, the system comprising:

a main body, wherein the main body includes a drive source and a gear which can be driven rotatable by the drive source and which includes a coupling protrusion in a radial direction;

a photosensitive drum;

a process unit which acts upon the photosensitive drum;

a coupling hole which is provided at an end part of a radial direction of the photosensitive drum;

wherein the photosensitive drum set in the main body rotates by receiving a drive force from a drive source via the coupling protrusion and the coupling hole when a cover member of the main body is closed, and the coupling protrusion and the coupling hole are fit together; and a member which slides the gear of the main body when the cover member is opened or closed;

wherein when the cover member is opened, the coupling protrusion of the gear and the coupling hole of the photosensitive drum are released from a fit state, and the process cartridge can be removed from the main body, and when the cover member is closed, the coupling hole of the photosensitive drum and the coupling protrusion of the gear are fit together, and the photosensitive drum can be driven rotatable by the drive source.

2. An image forming apparatus comprising:

a drive source which is detachably mountable to a main body, wherein the main body includes a gear which can be driven rotatable by the drive source and which includes a coupling protrusion in a radial direction;

a process cartridge having a photosensitive drum;

a process unit which acts upon the photosensitive drum;

a coupling hole which is provided at an end part of a radial direction of the photosensitive drum;

wherein the photosensitive drum set in the main body rotates by receiving a drive force from the drive source via the coupling protrusion and the coupling hole when a cover member of the main body is closed, and the coupling hole and the coupling protrusion are fit together;

support shafts which are formed protruding from a rotational center of the gear in an axial direction of the shafts; and supporting members which are provided on the main body and which support each of the support shafts respectively, wherein one of the supporting members supports one of the support shafts via a gap.

3. An image forming apparatus comprising:

a drive source which is detachably mountable to a main body, wherein the main body includes a gear which can be driven rotatable by the drive source and which includes a coupling protrusion in a radial direction;

a process cartridge having a photosensitive drum;

a process unit which acts upon the photosensitive drum;

a coupling hole which is provided at an end part of a radial direction of the photosensitive drum;

wherein the photosensitive drum set in the main body rotates by receiving a drive force from the drive source via the coupling protrusion and the coupling hole when a cover member of the main body is closed, and the coupling hole and the coupling protrusion are fit together; and a member which slides the gear of the main body when the cover member is opened or closed;

wherein when the cover member is opened, the coupling protrusion of the gear and the coupling hole of the photosensitive drum are released from a fit state, and the process cartridge can be removed from the main body, and when the cover member is closed, the coupling hole of the photosensitive drum and the coupling protrusion of the gear are fit together, and the photosensitive drum can be driven rotatable by the drive source.

4. An image forming apparatus comprising:

means for driving a gear;

a main body including a gear which can be driven rotatable by the means for driving a gear, wherein the gear includes a coupling protrusion in a radial direction;

a process cartridge having a photosensitive drum;

a process unit which acts upon the photosensitive drum; and a coupling hole which is provided at an end part of a radial direction of the photosensitive drum;

wherein the photosensitive drum set in the main body rotates by receiving a drive force from the means for driving a gear via the coupling protrusion and the coupling hole when a cover member of the main body is closed, and the coupling protrusion and the coupling hole are fit together.

5. The image forming apparatus according to claim 4, further comprising:

support shafts which are formed protruding from a rotational center of the gear in an axial direction of the shafts; and supporting members which are provided on the main body and which support each of the support shafts respectively, wherein one of the supporting members supports one of the support shafts via a gap.

6. The image forming apparatus according to claim 4, further comprising:

a member which slides the gear of the main body when the cover member is opened or closed;

wherein when the cover member is opened, the coupling protrusion of the gear and the coupling hole of the photosensitive drum are released from a fit state, and the process cartridge can be removed from the main body, and when the cover member is closed, the coupling hole of the photosensitive drum and the coupling protrusion of the gear are fit together, and the photosensitive drum can be driven rotatable by the means for driving a gear.

7. The image forming apparatus according to claim 4, wherein engaging surfaces are formed on each of or the coupling protrusion of the gear and a coupling hole which is provided at an end part of a longitudinal direction of the photosensitive drum, and the engaging surfaces are fit together such that a drive force of the means for driving a gear can be transmitted.

8. The image forming apparatus according to claim 4, wherein the gear includes a helical gear which slides in a direction the coupling protrusion of the gear and the coupling hole of the photosensitive drum are fit together when the drive force from the means for driving a gear is transmitted to the gear and the gear is rotated.

9. The image forming apparatus according to claim 4, wherein engaging surfaces are formed on each of the coupling protrusion of the gear and a coupling hole which is provided at an end part of a longitudinal direction of the photosensitive drum, and the engaging surfaces are fit together such that a drive force of the means for driving a gear can be transmitted; and the gear is a helical gear, and when the helical gear is moved towards a direction to separate from an end part of a longitudinal direction of the photosensitive drum such that to release the coupling protrusion of the gear and the coupling hole of the photosensitive drum from the fit state, the helical gear rotates in a direction opposite to a direction to transmit the drive force from the means for driving a gear by following the mesh between the helical gear and the gear which transmits the drive force to the helical gear.

10. The image forming apparatus according to claim 4, wherein the means for driving a gear is detachably mounted to the main body.

11. The image forming apparatus according to claim 4, wherein the means for driving a gear is a motor.

* * * * *